US012320604B2

(12) United States Patent
Lo

(10) Patent No.: US 12,320,604 B2
(45) Date of Patent: Jun. 3, 2025

(54) FIREARM SOUND SUPPRESSOR

(71) Applicant: Gustav Lo, Petoskey, MI (US)

(72) Inventor: Gustav Lo, Petoskey, MI (US)

( * ) Notice: Subject to any disclaimer, the term of this patent is extended or adjusted under 35 U.S.C. 154(b) by 0 days.

(21) Appl. No.: 18/667,230

(22) Filed: May 17, 2024

(65) Prior Publication Data

US 2024/0302122 A1 Sep. 12, 2024

Related U.S. Application Data

(63) Continuation of application No. 18/524,183, filed on Nov. 30, 2023, which is a continuation of application No. 17/217,771, filed on Mar. 30, 2021, now Pat. No. 11,835,315, which is a continuation of application No. 16/887,137, filed on May 29, 2020, now Pat. No. 10,976,126, which is a continuation of application No. 16/266,843, filed on Feb. 4, 2019, now Pat. No. 10,684,088.

(60) Provisional application No. 62/626,871, filed on Feb. 6, 2018.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 658,934 A 10/1900 Washington
981,584 A 1/1911 Miller
1,487,312 A 3/1924 Bull
1,605,864 A 11/1926 Steinegger
1,763,286 A 6/1930 Zygmunt
1,763,287 A 6/1930 Zygmunt
2,112,831 A 4/1938 Cutts, Jr.
2,216,653 A 10/1940 Urban
4,939,977 A 7/1990 Stroup
(Continued)

FOREIGN PATENT DOCUMENTS

DE 661830 C 6/1938
DE 695928 C 9/1940
(Continued)

OTHER PUBLICATIONS

European Patent Office, Supplementary European Search Report for EP App. No. 19750657, mailed Sep. 28, 2021. Sep. 28, 2021.
(Continued)

*Primary Examiner* — Reginald S Tillman, Jr.
(74) *Attorney, Agent, or Firm* — Miller Johnson

(57) ABSTRACT

A suppressor for a firearm includes a housing, a cylindrical construct, and a structure. The cylindrical construct is disposed within the housing and surrounds a central pathway along a central axis of the suppressor. The cylindrical construct defines a plurality of apertures. The structure is disposed within the housing and surrounds the cylindrical construct. The structure extends along the central axis and includes a plurality of walls. The plurality of walls define a first fluid passage and a second fluid passage in fluid communication with the first fluid passage. At least one of the plurality of apertures is in fluid communication with the central pathway, the first fluid passage, and the second fluid passage.

11 Claims, 19 Drawing Sheets

(56) References Cited

U.S. PATENT DOCUMENTS

| | | | | |
|---|---|---|---|---|
| 6,575,074 | B1 * | 6/2003 | Gaddini | F41A 21/30 89/14.4 |
| 8,286,750 | B1 | 10/2012 | Oliver | |
| 8,322,266 | B2 | 12/2012 | Presz, Jr. et al. | |
| 9,316,456 | B1 | 4/2016 | Oliver | |
| 9,347,727 | B1 | 5/2016 | Cler | |
| 9,739,559 | B2 | 8/2017 | Bush | |
| 9,759,447 | B1 * | 9/2017 | Mathur | G10K 11/168 |
| 10,077,962 | B1 | 9/2018 | Dean | |
| 10,088,260 | B1 | 10/2018 | Badanin | |
| 10,094,633 | B2 | 10/2018 | Hugo | |
| 10,330,417 | B2 | 6/2019 | Reis Green | |
| 10,458,737 | B2 | 10/2019 | Schwartzkopf et al. | |
| 10,684,088 | B2 | 6/2020 | Lo | |
| 2008/0057686 | A1 | 3/2008 | Melgaard | |
| 2010/0026334 | A1 | 2/2010 | Holger | |
| 2012/0272818 | A1 | 11/2012 | Dueck | |
| 2013/0168181 | A1 | 7/2013 | Wirth | |
| 2015/0308772 | A1 * | 10/2015 | James | F41A 21/30 89/14.4 |
| 2017/0067711 | A1 * | 3/2017 | Slack | F41A 21/30 |
| 2017/0074613 | A1 | 3/2017 | Shults et al. | |
| 2017/0102202 | A1 | 4/2017 | Augustine et al. | |
| 2017/0299312 | A1 | 10/2017 | Llewellyn, Jr. | |
| 2017/0321985 | A1 | 11/2017 | Bray | |
| 2018/0202744 | A1 | 7/2018 | De Sousa | |
| 2018/0209757 | A1 | 7/2018 | Hibbitts et al. | |
| 2018/0239374 | A1 | 8/2018 | Doore | |
| 2019/0063859 | A1 | 2/2019 | Gilpin | |

FOREIGN PATENT DOCUMENTS

| | | | |
|---|---|---|---|
| EP | 2224200 | B1 | 9/2015 |
| FR | 493462 | A | 8/1919 |
| FR | 492535 | A | 7/2019 |
| GB | 2287780 | A | 9/1995 |

OTHER PUBLICATIONS

International Search Report and Written Opinion for the related PCT Application No. PCT/US2019/016579 dated May 21, 2019.

Scientific Reports Article, Hybrid acoustic metamaterial as super absorber for broadband low-frequency sound, published Feb. 27, 2017, <https://www.nature.com/articles/srep43340>.

Non-Final Office Action dated Oct. 11, 2019, by the U.S. Patent and Trademark Office relating to U.S. Appl. No. 16/266,843.

USPTO, Non-Final Office Action for U.S. Appl. No. 17/217,771, mailed Jun. 14, 2022.

Extended European Search Report for EP24202051.9 dated Nov. 25, 2024, 9 pages.

* cited by examiner

FIREARM SOUND SUPPRESSOR

CROSS REFERENCE TO RELATED APPLICATIONS

This U.S. patent application is a continuation of, and claims priority under 35 U.S.C. § 120 from, Ser. No. 18/524,183, filed on Nov. 30, 2023, which is a continuation of, and claims priority under 35 U.S.C. § 120 from, U.S. patent application Ser. No. 17/217,771, filed on Mar. 30, 2021, which is a continuation of, and claims priority under 35 U.S.C. § 120 from, U.S. patent application Ser. No. 16/887,137, filed on May 29, 2020, which is a continuation of, and claims priority under 35 U.S.C. § 120 from, U.S. patent application Ser. No. 16/266,843, filed on Feb. 4, 2019, which claims the benefit under 35 U.S.C. § 119(e) to U.S. Provisional Application No. 62/626,871, filed on Feb. 6, 2018. The disclosures of these prior applications are considered part of the disclosure of this application and are hereby incorporated by reference in their entireties.

FIELD

The present disclosure relates generally to a sound suppressor for a firearm.

BACKGROUND

This section provides background information related to the present disclosure and is not necessarily prior art.

Sound is generated by numerous sources when a firearm is discharged or otherwise fired. For example, high-temperature and high-pressure propellant gases escaping and expanding from the muzzle of the firearm can generate a shockwave that produces a loud muzzle blast. Sound suppressors are often used with firearms to slow or cool down the escaping propellant gas, thereby reducing the amount of noise (e.g., sound intensity or volume) generated when the firearm is discharged. Such suppressors often employ baffles, spacers, or packing material to affect the slowing or cooling down of the escaping propellant gas.

While known firearm sound suppressors have proven acceptable for their intended purposes, a continuous need for improvement in the relevant art remains.

SUMMARY

This section provides a general summary of the disclosure, and is not a comprehensive disclosure of its full scope or all of its features.

One aspect of the disclosure provides a sound suppressor for a firearm. The sound suppressor may include a housing, an outer shell, an inner shell, and an intermediate member. The housing may extend along, and be disposed about, a central axis. The outer shell may be concentrically disposed within the housing. The inner shell may be concentrically disposed within the outer shell and define a plurality of first apertures. The intermediate member may be disposed between the inner shell and the outer shell and formed at least in part from an acoustic metamaterial.

Implementations of the disclosure may include one or more of the following optional features. In some implementations, each of the first apertures defines a maximum dimension extending across the first aperture. The maximum dimension may be less than one millimeter. In some implementations, the maximum dimension is less than a half millimeter. Each of the first apertures may extend through a thickness of the inner shell. The thickness may be greater than two hundred percent of the maximum dimension.

In some implementations, at least one of the inner shell or the outer shell is formed from one of aluminum or an aluminum alloy.

In some implementations, the sound suppressor includes a sleeve disposed within the inner shell and including a plurality of undulations defining a plurality of second apertures. The sleeve may define a central passage in fluid communication with the plurality of first apertures and the plurality of second apertures. Each of the second apertures may define a second maximum dimension extending across the second aperture. The second maximum dimension may be less than one millimeter. In some implementations, the second maximum dimension is less than a half millimeter. In some implementations, each of the second apertures extends through a thickness of the sleeve. The thickness may be greater than two hundred percent of the second maximum dimension. The sleeve may be formed from one of aluminum or an aluminum alloy. In some implementations, each of the plurality of undulations defines a U-shape or a V-shape.

Another aspect of the disclosure provides a sound suppressor for a firearm. The sound suppressor may include a housing and a door. The housing may extend from a proximal end to a distal end along a central passage. The proximal end may be configured to receive the firearm. The distal end may define an exit opening. The door may be pivotally supported by the housing for rotation between an open position and a closed position. The door may at least partially block the exit opening in the closed position and be configured to rotate from the open position to the closed position upon passage of a projectile through the exit opening.

Implementations of this aspect of the disclosure may include one or more of the following optional features. In some implementations, the sound suppressor includes a biasing member operable to rotate the door from the closed position to the open position after passage of the projectile through the exit opening.

In some implementations, the sound suppressor includes an outer shell, an inner shell, and an intermediate member. The outer shell may be concentrically disposed within the housing. The inner shell may be concentrically disposed within the outer shell and defining a plurality of apertures. The intermediate member may be disposed between the inner shell and the outer shell and formed at least in part from an acoustic metamaterial. Each of the apertures may define a maximum dimension extending across the aperture. The maximum dimension may be less than one millimeter.

In some implementations, the sound suppressor includes a sleeve disposed within the housing. The sleeve may include a plurality of undulations defining a plurality of apertures in fluid communication with the central passage. Each of the plurality of undulations may define a U-shape or a V-shape. Each of the apertures may define a maximum dimension extending across the aperture. The maximum dimension may be less than one millimeter.

Yet another aspect of the disclosure provides a sound suppressor for a firearm. The sound suppressor may include a housing and a first sleeve. The housing may extend along, and be disposed about, a central axis. The first sleeve may be concentrically disposed within the housing and may define a plurality of first undulations disposed about the central axis. Each first undulation may define a plurality of first apertures.

Implementations of this aspect of the disclosure may include one or more of the following optional features. In some implementations, each of the first apertures defines a first maximum dimension extending across the first aperture. In some implementations, the first maximum dimension is less than one millimeter. In some implementations, the first maximum dimension is less than a half millimeter.

In some implementations, the sound suppressor includes a second sleeve. The second sleeve may be concentrically disposed within the first sleeve and may define a plurality of second undulations disposed about the central axis. Each second undulation may define a plurality of second apertures. Each of the second apertures may define a second maximum dimension extending across the second aperture. In some implementations, the second maximum dimension is less than one millimeter. Each of the first apertures may extend through a thickness of the first sleeve. The thickness may be greater than two hundred percent of the first maximum dimension.

In some implementations, at least one of the first sleeve or the second sleeve is formed from one of aluminum or an aluminum alloy.

In some implementations, each of the plurality of first undulations defines a U-shape or a V-shape.

A further aspect of the disclosure provides a sound suppressor for a firearm. The sound suppressor may include a housing and a first sleeve. The housing may define a first central passage. The first sleeve may be disposed within the first central passage and may include a plurality of first undulations defining a second central passage. Each first undulation may define a plurality of first apertures in fluid communication with the first central passage and the second central passage.

Implementations of this aspect of the disclosure may include one or more of the following optional features. In some implementations, each of the first apertures defines a first maximum dimension extending across the first aperture. The first maximum dimension may be less than one millimeter. In some implementations, the first maximum dimension is less than a half millimeter.

In some implementations, the sound suppressor includes a second sleeve. The second sleeve may be disposed within the second central passage and may include a plurality of second undulations defining a third central passage. Each second undulation may define a plurality of second apertures in fluid communication with the second central passage and the third central passage. Each of the second apertures may define a second maximum dimension extending across the second aperture. In some implementations, the second maximum dimension is less than one millimeter.

Each of the first apertures may extend through a thickness of the first sleeve. The thickness may be greater than two hundred percent of the first maximum dimension.

In some implementations, at least one of the first sleeve or the second sleeve is formed from one of aluminum or an aluminum alloy.

In some implementations, each of the plurality of first undulations defines a U-shape or a V-shape.

Yet another aspect of the disclosure provides a sound suppressor for a firearm. The sound suppressor may include a housing and a first sleeve. The first sleeve may be disposed within the housing and may include a first inner surface and a first outer surface. At least one of the first inner surface or the first outer surface may define a plurality of first undulations. Each first undulation may define a plurality of first apertures extending through the first inner surface and the first outer surface.

Implementations of this aspect of the disclosure may include one or more of the following optional features. In some implementations, each of the first apertures defines a first maximum dimension extending across the first aperture. The first maximum dimension may be less than one millimeter. In some implementations, the first maximum dimension is less than a half millimeter.

In some implementations, the sound suppressor includes a second sleeve. The second sleeve may be disposed within the first sleeve and may include a second inner surface and a second outer surface. At least one of the second inner surface or the second outer surface may define a plurality of second undulations. Each second undulation may define a plurality of second apertures extending through the second inner surface and the second outer surface. Each of the second apertures may define a second maximum dimension extending across the second aperture. In some implementations, the second maximum dimension is less than one millimeter.

Each of the first apertures may extend through a thickness of the first sleeve. The thickness may be greater than two hundred percent of the first maximum dimension.

In some implementations, at least one of the first sleeve or the second sleeve is formed from one of aluminum or an aluminum alloy.

In some implementations, each of the plurality of first undulations defines a U-shape or a V-shape.

Another aspect of the present disclosure provides a sound suppressor kit for a firearm. The sound suppressor kit includes a housing, a first shell assembly, and a second shell assembly. The first shell assembly is configured to be removably coupled to the housing and configured to reduce a volume of a first sound having a first frequency. The second shell assembly is configured to be removably coupled to the housing and configured to reduce a volume of a second sound having a second frequency that is different than the first frequency.

Implementations of this aspect of the disclosure may include one or more of the following optional features. In some implementations, the housing defines an opening and a passage in fluid communication with the opening. The first shell assembly and the second shell assembly may each be configured to be removably inserted through the opening and into the passage.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected configurations and not all possible implementations, and are not intended to limit the scope of the present disclosure.

Corresponding reference numerals indicate corresponding parts throughout the drawings

DETAILED DESCRIPTION

Figure 1:
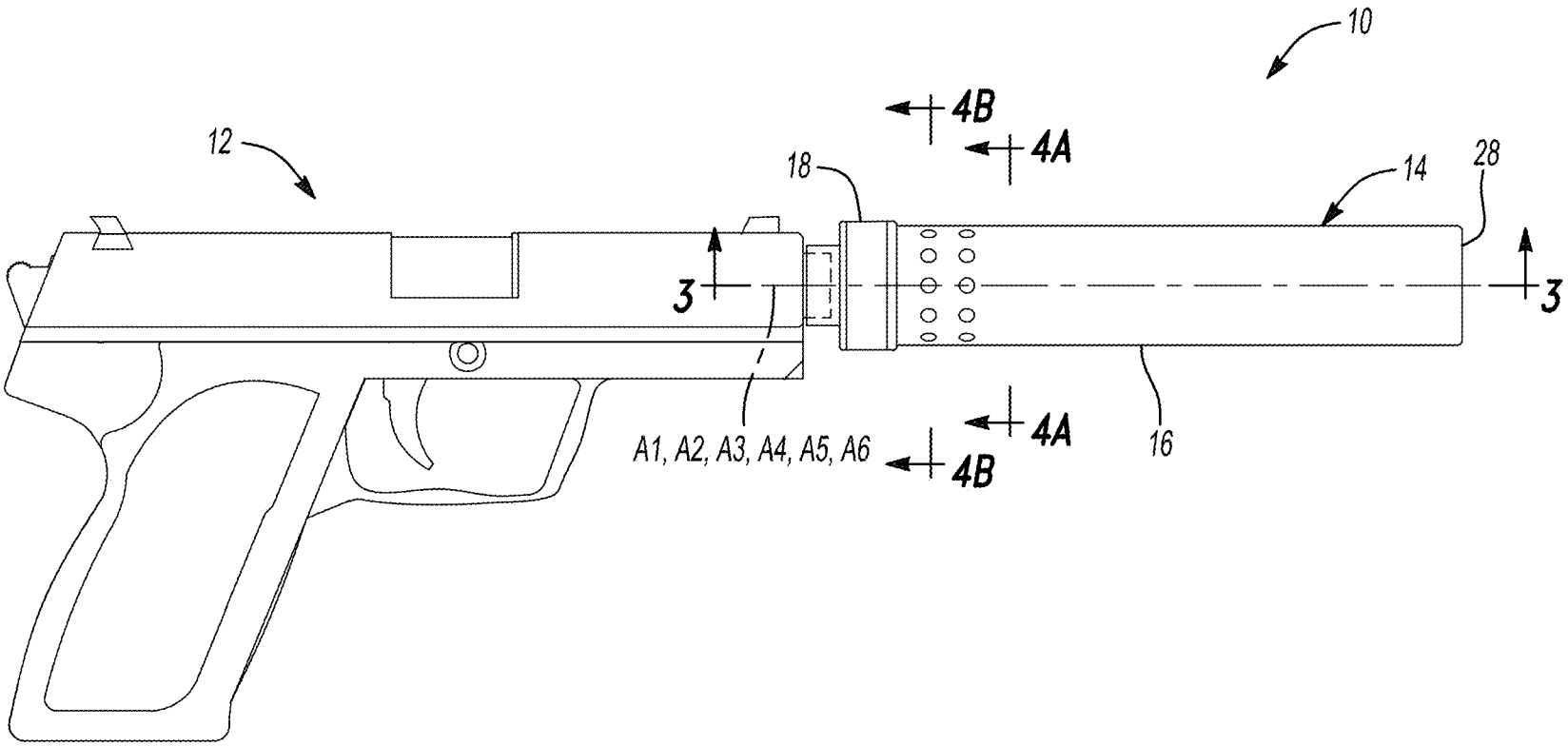
FIG. 1 is a side view of a firearm including a sound suppressor in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to FIG. 1, a firearm system 10, including a firearm 12 and a sound suppressor 14, is shown. While the firearm 12 is shown as being a pistol-type firearm, it will be appreciated that the firearm system 10 may include other types of firearms 10 within the scope of the present disclosure.

With reference to FIGS. 2-4B, the sound suppressor 14 may include a housing 16, an endcap 18, one or more inner sleeves 20, one or more baffles 22, an expansion device 23, and an insulator 24. The housing 16 may extend along a longitudinal axis A1 and include a proximal end 26, a distal end 28, an inner surface 30, and an outer surface 32. The distal end 28 may be opposite the proximal end 26. The housing 16 may be formed from one or more of a variety of materials, including, for example, aluminum, steel, or another suitable metal material.

Figure 2:
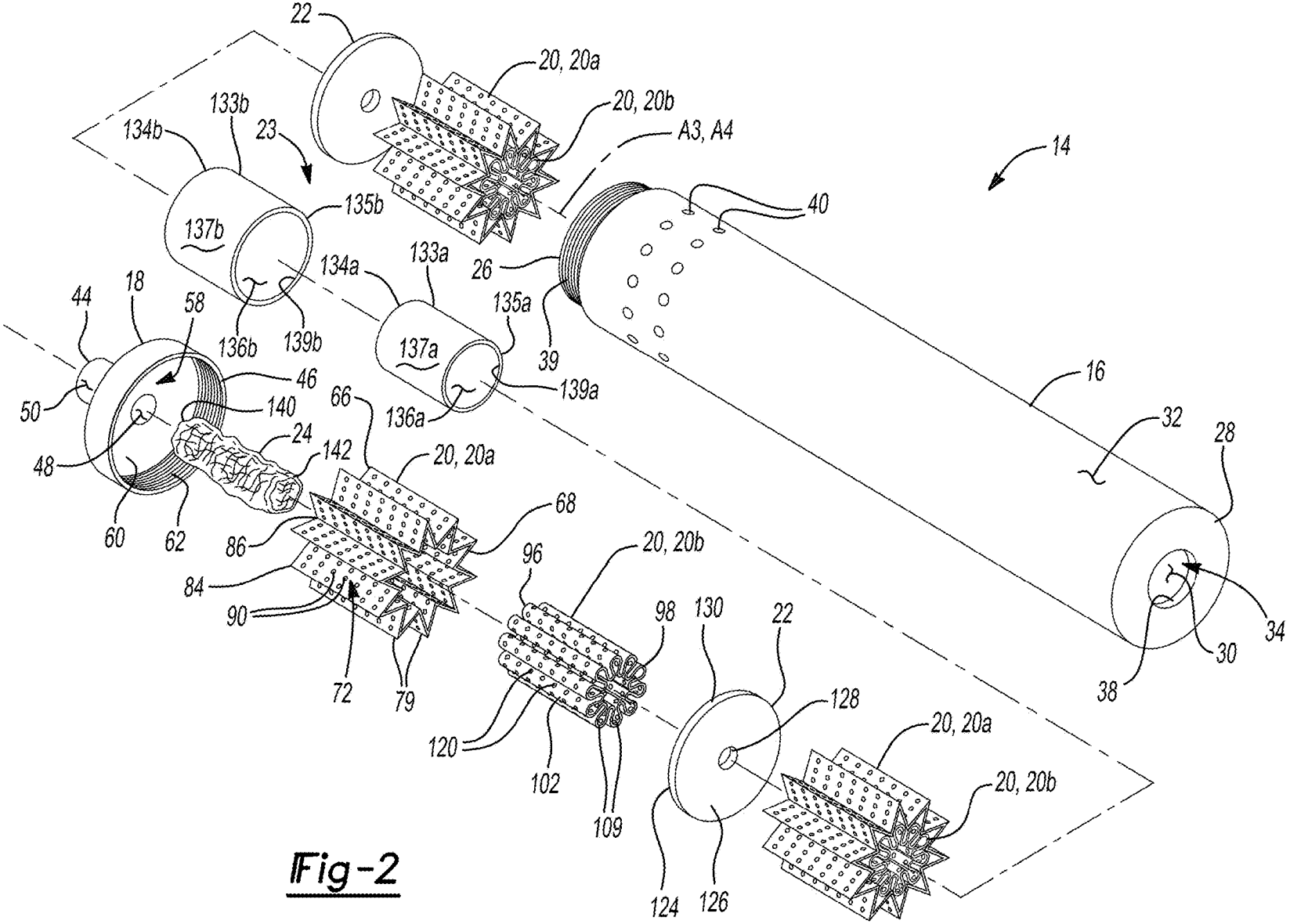
FIG. 2 is an exploded view of the sound suppressor of FIG. 1.

As illustrated in FIG. 2, the inner and outer surfaces 30, 32 may surround and extend along the longitudinal axis A1 from the proximal end 26 to the distal end 28, such that the inner and outer surfaces 30, 32 define a thickness T1 (FIG. 4A) extending therebetween in a direction substantially perpendicular to the inner and outer surfaces 30, 32. Accordingly, the inner surface 30 may define a passage 34 extending through the housing 16 from the proximal end 26 to the distal end 28. The proximal end 26 of the housing 16 may define an entrance opening 35, while the distal end 28 of the housing 16 may define an exit opening 38. In this regard, the entrance opening 35 may be in fluid communication with the exit opening 38 through the passage 34.

In some implementations, the inner and outer surfaces 30, 32 each define a cylinder or a polygonal prism, such that the thickness T1 is uniform along and about the longitudinal axis A1. It will be appreciated, however, that the inner or outer surface 30, 32 may define other shapes within the scope of the present disclosure, such that the thickness T1 varies along or about the longitudinal axis A1.

A portion of the inner or outer surface 30, 32 may include a threaded portion 36 for securing the housing 16 to the endcap 18. For example, as illustrated in FIG. 3, in some implementations, the outer surface 32 includes a male threaded portion 39 extending from the proximal end 26 along and about the longitudinal axis A1.

Figure 3:
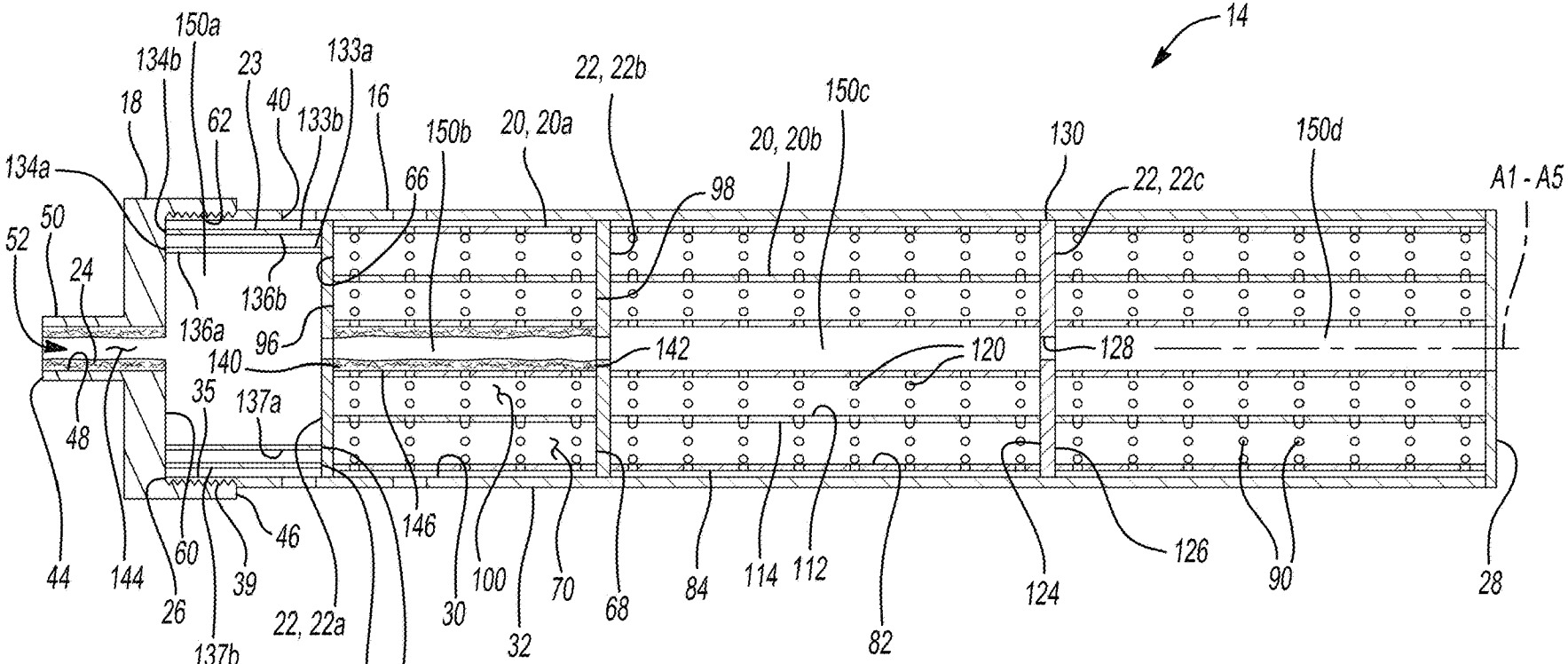
FIG. 3 is a cross-sectional view of the sound suppressor of FIG. 1 taken through the line 3-3.
Figure 4A:
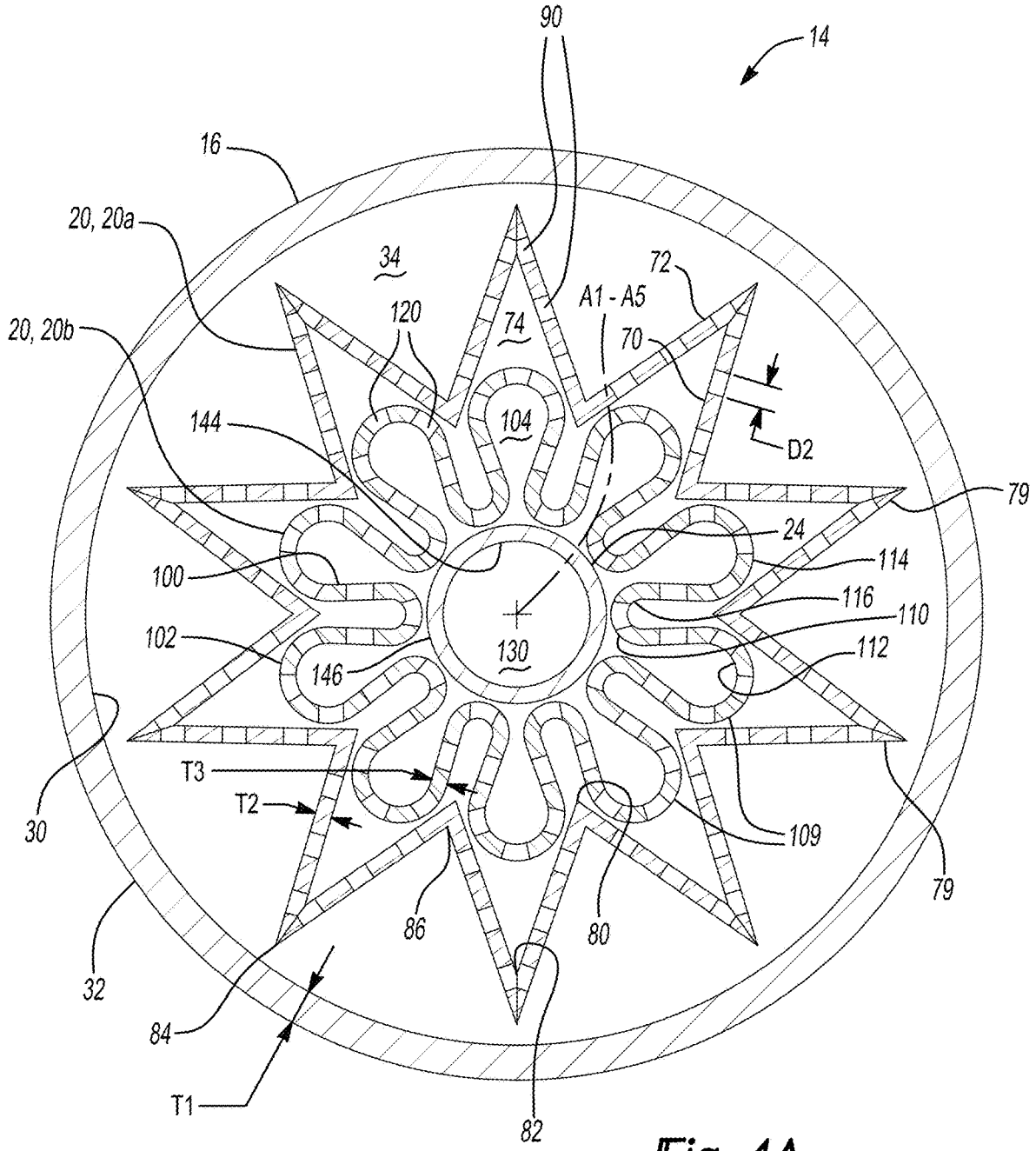
FIG. 4A is a cross-sectional view of the sound suppressor of FIG. 1 taken through the line 4A-4A.
Figure 4B:
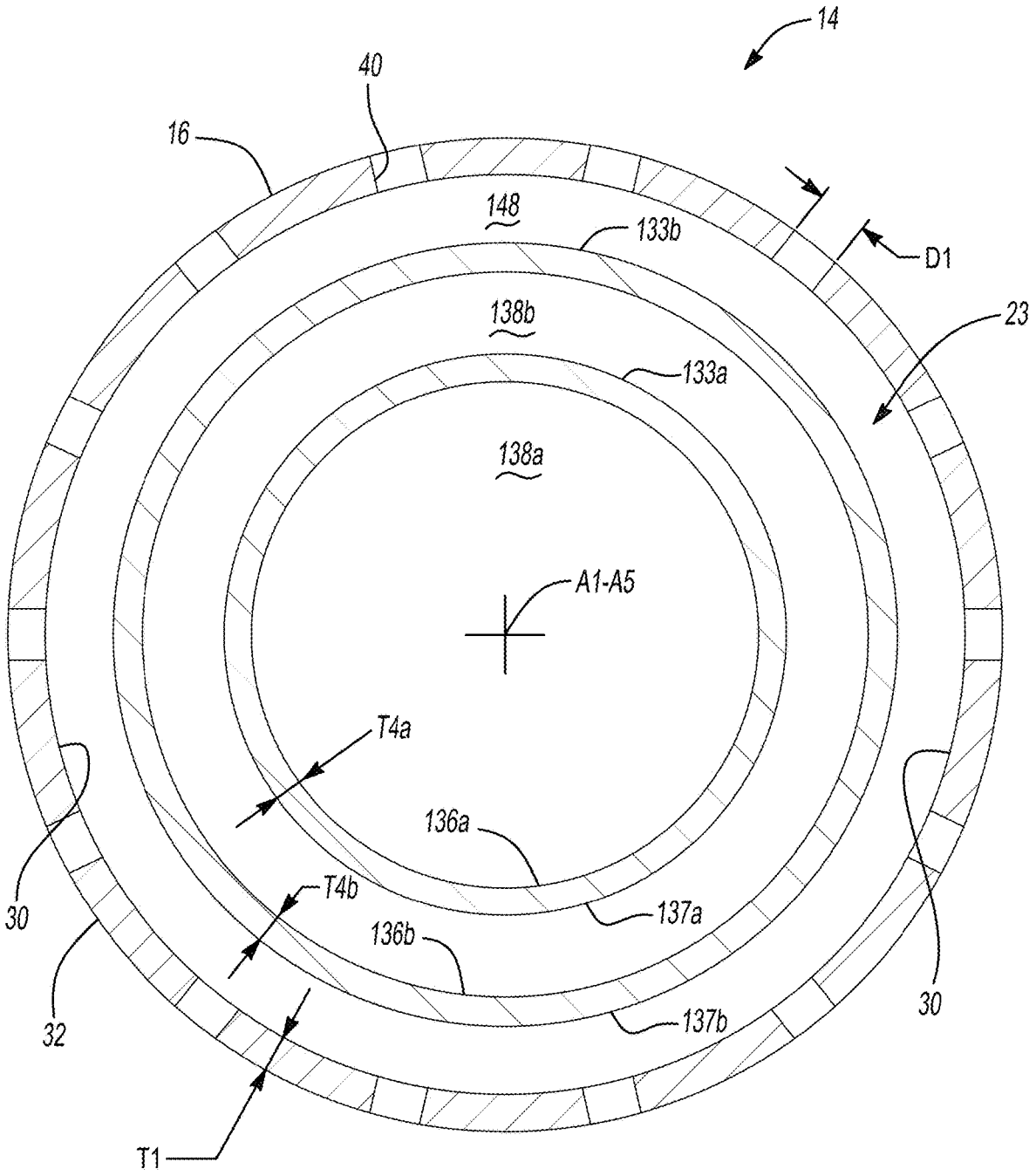
FIG. 4B is a cross-sectional view of the sound suppressor of FIG. 1 taken through the line 4B-4B.

As illustrated in FIGS. 2, 3, and 4B, the housing 16 may define a plurality of perforations or apertures 40 extending through the inner and outer surfaces 30, 32. In some implementations, the apertures 40 define a circular or cylindrical shape extending through the inner and outer surfaces 30, 32. In this regard, the apertures 40 may define a diameter greater than 0.75 millimeters. In particular, the apertures 40 may define a diameter greater than 1.0 millimeter. The apertures 40 may collectively define one or more patterns extending along or about the longitudinal axis A1. For example, in some implementations, the apertures 40 may collectively define a helical pattern extending from the proximal end 26 to the distal end 28. In some implementations, a plurality of groups of the apertures 40 may each collectively define a circle extending about the longitudinal axis A1, such that the plurality of groups of the apertures 40 collectively define (i) a plurality of circular patterns extending about the longitudinal axis A1 and (ii) a plurality of linear patterns extending along (e.g., substantially parallel to) the longitudinal axis A1.

With reference to FIG. 2, the endcap 18 may extend along a longitudinal axis A2 and include a proximal end 44, a distal end 46, an inner surface 48, and an outer surface 50. The distal end 46 may be opposite the proximal end 44. As illustrated in FIG. 3, the inner surface 48 may surround and extend along the longitudinal axis A2 from the proximal end 44 toward the distal end 46. Accordingly, the inner surface 48 may define a passage 52 extending through the endcap 18 from the proximal end 44 toward the distal end 46. In some implementations, the distal end 46 of the endcap 18 may include a counterbore 58 defined in part by a shoulder 60 extending radially outward from the inner surface 48 of the endcap 18. The counterbore 58 may include a threaded portion 62 extending from the distal end 46 toward the shoulder 60 to threadingly engage the threaded portion 39 of the housing 16 in the assembled configuration.

With reference to FIGS. 2-4B, the one or more inner sleeves 20 may include a first inner sleeve 20*a* and a second inner sleeve 20*b*. As illustrated in FIGS. 3 and 4A, in the assembled configuration, the first inner sleeve 20*a* may be disposed within the housing 16, and the second inner sleeve 20*b* may be disposed within the first inner sleeve 20*a*.

The first inner sleeve 20*a* may define a hollow construct extending along a longitudinal axis A3 and having a proximal end 66, a distal end 68, an inner surface 70, and an outer surface 72. In some implementations, the first inner sleeve 20*a* may define a polygonal prism extending along the longitudinal axis A3. The distal end 68 may be opposite the proximal end 66. The first inner sleeve 20*a* may be formed from one or more of a variety of materials, including, for example, aluminum, steel, or another suitable metal material.

As illustrated in FIG. 2, the inner and outer surfaces 70, 72 may surround and extend along the longitudinal axis A3 from the proximal end 66 to the distal end 68, such that the inner and outer surfaces 70, 72 define a thickness T2 (FIG. 4A) extending therebetween in a direction substantially perpendicular to the inner and outer surfaces 70, 72. Accordingly, the inner surface 70 may define a passage 74 extending through the first inner sleeve 20*a* from the proximal end 66 to the distal end 68. The proximal end 66 of the first inner sleeve 20*a* may define an entrance opening, while the distal end 68 of the first inner sleeve 20*a* may define an exit opening. In this regard, the entrance opening may be in fluid communication with the exit opening through the passage 74.

In some implementations, the inner or outer surface 70, 72 each define a plurality of undulations 79 disposed about the longitudinal axis A3. As illustrated in FIG. 4A, in some implementations, the undulations 79 define V-shapes or profiles disposed symmetrically about the longitudinal axis A3. It will be appreciated, however, that the undulations 79 may define other shapes (e.g., U-shape, a square wave shape, etc.) within the scope of the present disclosure. In this regard, the inner surface 70 may define a plurality of inner peaks 80 and inner troughs 82 corresponding to, or collectively defining, minimum and maximum diameters, respectively, of the inner surface 70, while the outer surface 72 may define a plurality of outer peaks 84 and outer troughs 86 corresponding to, or collectively defining, minimum and maximum diameters, respectively, of the outer surface 72. While the inner and outer surfaces 70, 72 are illustrated to define ten peaks 80, 84 and ten troughs 82, 86, it will be appreciated that the inner and outer surfaces 70, 72 may define more or less than ten peaks 80, 84 or ten troughs 82, 86 within the scope of the present disclosure.

Each inner peak 80 of the inner surface 70 may be aligned with an outer trough 86 of the outer surface 72, while each inner trough 82 of the inner surface 70 may be aligned with an outer peak 84 of the outer surface 72. In some implementations, the inner surface 70 is substantially parallel to the outer surface 72, and each peak 80, 84 and each trough 82, 86 extends in a direction substantially parallel to the longitudinal axis A3. In this regard, the thickness T2 may be uniform along and about the longitudinal axis A3. It will be appreciated, however, that the inner or outer surface 70, 72 may define other shapes, or one or more of the peaks 80, 84 or troughs 82, 86 may extend in a direction transverse (e.g., helical) to the longitudinal axis A3, within the scope of the present disclosure. In this regard, the thickness T2 may vary along or about the longitudinal axis A3.

As illustrated in FIGS. 2, 3, and 4A, the first inner sleeve 20*a* may define a plurality of perforations or apertures 90 extending through the inner and outer surfaces 70, 72. The apertures 90 may define a maximum dimension D2 (FIG. 4A) extending across the apertures 90 as the apertures 90 extend through the first inner sleeve 20*a*. The maximum dimension D2 may be less than 1.0 millimeter. In particular, the maximum dimension D2 may be less than 0.50 millimeter. In some implementations, the maximum dimension D2 is less than 0.20 millimeter. The thickness T2 of the first inner sleeve 20*a* may be between 100% and 500% of the maximum dimension D2 of the apertures 90. In some implementations, the thickness T2 of the first inner sleeve 20*a* is greater than 500% of the maximum dimension D2 of the apertures 90. In some implementations, the apertures 90 define a circular or cylindrical shape extending through the inner and outer surfaces 70, 72. In this regard, the maximum dimension D2 may define a diameter D2.

The apertures 90 may collectively define one or more patterns extending along or about the longitudinal axis A3. For example, in some implementations, the apertures 90 may collectively define a helical pattern extending from the proximal end 66 to the distal end 68. In some implementations, a plurality of groups of the apertures 90 may each collectively define a circle extending about the longitudinal axis A3, such that the plurality of groups of the apertures 90 collectively define (i) a plurality of circular patterns extending about the longitudinal axis A3 and (ii) a plurality of linear patterns extending along (e.g., substantially parallel to) the longitudinal axis A3. In this regard, the distance between each aperture 90 and an adjacent aperture 90 may be less than 10 millimeters. In some implementations, the distance between each aperture 90 and an adjacent aperture 90 is less than 5 millimeters. In this regard, the distance between each aperture 90 and an adjacent aperture 90 may be between 100% and 5000% of the maximum dimension D2 of the apertures 90.

The second inner sleeve 20*b* may define a hollow construct extending along a longitudinal axis A4 and having a proximal end 96, a distal end 98, an inner surface 100, and an outer surface 102. The distal end 98 may be opposite the proximal end 96. The second inner sleeve 20*b* may be formed from one or more of a variety of materials, including, for example, aluminum, steel, or another suitable metal material.

As illustrated in FIG. 2, the inner and outer surfaces 100, 102 may surround and extend along the longitudinal axis A4 from the proximal end 96 to the distal end 98, such that the inner and outer surfaces 100, 102 define a thickness T3 (FIG. 4A) extending therebetween in a direction substantially perpendicular to the inner and outer surfaces 100, 102. Accordingly, the inner surface 100 may define a passage 104 extending through the second inner sleeve 20*b* from the proximal end 96 to the distal end 98. The proximal end 96 of the second inner sleeve 20*b* may define an entrance opening, while the distal end 98 of the second inner sleeve 20*b* may define an exit opening. In this regard, the entrance opening may be in fluid communication with the exit opening through the passage 104.

In some implementations, the inner or outer surface 100, 102 each define a plurality of undulations 109 disposed about the longitudinal axis A4. As illustrated in FIG. 4A, in some implementations, the undulations 109 define U-shapes or profiles disposed symmetrically about the longitudinal axis A4. It will be appreciated, however, that the undulations 109 may define other shapes (e.g., V-shape, a square wave shape, etc.) within the scope of the present disclosure. In this regard, the inner surface 100 may define a plurality of inner peaks 110 and inner troughs 112 corresponding to, or collectively defining, minimum and maximum diameters, respectively, of the inner surface 100, while the outer surface 102 may define a plurality of outer peaks 114 and outer troughs 116 corresponding to, or collectively defining, minimum and maximum diameters, respectively, of the outer surface 102. While the inner and outer surfaces 100, 102 are illustrated to define ten peaks 110, 114 and ten troughs 112, 116, it will be appreciated that the inner and outer surfaces 100, 102 may define more or less than ten peaks 110, 114 and ten troughs 112, 116 within the scope of the present disclosure.

Each inner peak 110 of the inner surface 100 may be aligned with an outer trough 116 of the outer surface 102, while each inner trough 112 of the inner surface 100 may be aligned with an outer peak 114 of the outer surface 102. In some implementations, the inner surface 100 is substantially parallel to the outer surface 102, and each peak 110, 114 and each trough 112, 116 extends in a direction substantially parallel to the longitudinal axis A4. In this regard, the thickness T3 may be uniform along and about the longitudinal axis A4. It will be appreciated, however, that the inner or outer surface 100, 102 may define other shapes, or one or more of the peaks 110, 114 or troughs 112, 116 may extend in a direction transverse (e.g., helical) to the longitudinal axis A4, within the scope of the present disclosure. In this regard, the thickness T3 may vary along or about the longitudinal axis A4.

As illustrated in FIGS. 2, 3, and 4A, the second inner sleeve 20*b* may define a plurality of perforations or apertures 120 extending through the inner and outer surfaces 100, 102. The apertures 120 may define a maximum dimension D3 extending across the apertures 120 as the apertures 120 extend through the second inner sleeve 20*b*. The maximum dimension D3 may be less than 1.0 millimeter. In particular, the maximum dimension D3 may be less than 0.50 millimeter. In some implementations, the maximum dimension D3 is less than 0.20 millimeter. The thickness T3 of the second inner sleeve 20*b* may be between 100% and 500% of the maximum dimension D3 of the apertures 120. In some implementations, the thickness T3 of the second inner sleeve 20*b* is greater than 500% of the maximum dimension D3 of the apertures 120. In some implementations, the apertures 120 define a circular or cylindrical shape extending through the inner and outer surfaces 100, 102. In this regard, the maximum dimension D3 may define a diameter D3.

The apertures 120 may collectively define one or more patterns extending along or about the longitudinal axis A4. For example, in some implementations, the apertures 120 may collectively define a helical pattern extending from the proximal end 96 to the distal end 98. In some implementations, a plurality of groups of the apertures 120 may each collectively define a circle extending about the longitudinal axis A4, such that the plurality of groups of the apertures 120 collectively define (i) a plurality of circular patterns extending about the longitudinal axis A4 and (ii) a plurality of linear patterns extending along (e.g., substantially parallel to) the longitudinal axis A4. In this regard, the distance between each aperture 120 and an adjacent aperture 120 may be less than 10 millimeters. In some implementations, the distance between each aperture 120 and an adjacent aperture 120 is less than 5 millimeters. In this regard, the distance between each aperture 120 and an adjacent aperture 120 may be between 100% and 5000% of the diameter D3 of the apertures 120.

With reference to FIGS. 2 and 3, each baffle 22 may define a cylindrical construct having a proximal end 124, a distal end 126, an inner surface 128, and an outer surface 130. The distal end 126 may be opposite the proximal end 124. The baffles 22 may be formed from one or more of a variety of materials, including, for example, aluminum, steel, or another suitable metal material.

As illustrated in FIG. 2, the inner and outer surfaces 128, 130 may surround and extend along the longitudinal axis A4 from the proximal end 124 to the distal end 126. Accordingly, the inner surface 128 may define a passage 132 extending through the baffle 22 from the proximal end 124 to the distal end 126. The proximal end 124 of the baffle 22 may define an entrance opening, while the distal end 126 of the baffle 22 may define an exit opening. In this regard, the entrance opening may be in fluid communication with the exit opening through the passage 132.

The expansion device 23 may extend along a longitudinal axis A5 and include an inner member 133*a* and an outer member 133*b*. The inner and outer members 133*a*, 133*b* may each include, respectively, a proximal end 134*a*, 134*b*, a distal end 135*a*, 135*b*, an inner surface 136*a*, 136*b*, and an outer surface 137*a*, 137*b*. The distal end 135*a*, 135*b* may be opposite the proximal end 134*a*, 134*b*, respectively. The expansion device 23, including each of the inner and outer members 133*a*, 133*b*, may be formed from one or more of a variety of materials, including, for example, aluminum, steel, or another suitable metal material.

As illustrated in FIG. 3, the inner surfaces 136*a*, 136*b* and the outer surfaces 137*a*, 137*b* may surround and extend along the longitudinal axis A5 from the proximal end 134*a*, 134*b* to the distal end 135*a*, 135*b*, respectively, such that the inner surfaces 136*a*, 136*b* and outer surfaces 137*a*, 137*b* define thicknesses T4*a*, T4*b*, respectively, (FIG. 4B) extending therebetween in a direction substantially perpendicular to the inner surfaces 136*a*, 136*b* and outer surfaces 137*a*, 137*b*. Accordingly, the inner surface 136*a* of the inner member 133*a* may define a passage 138*a* extending therethrough from the proximal end 134*a* to the distal end 135*a*, while the inner surface 136*b* of the outer member 133*b* may define a passage 138*b* extending therethrough from the proximal end 134*b* to the distal end 135*b*. As illustrated in FIG. 4B, the inner member 133*a* may be disposed within (e.g., concentrically) the outer member 133*b* such that the passage 138*b* is defined by the outer surface 137*a* of the inner member 133*a* and the inner surface 136*b* of the outer member 133*b*.

The proximal end 134*a*, 134*b* of the inner and outer members 133*a*, 133*b*, respectively, may define an entrance opening, while the distal end 135*a*, 135*b* of the inner and outer members 133*a*, 133*b*, respectively, may define an exit opening 139*a*, 139*b*. In this regard, the entrance opening may be in fluid communication with the exit opening 139*a*, 139*b* through the passage 138*a*, 138*b*, respectively.

In some implementations, the inner surfaces 136*a*, 136*b* and the outer surfaces 137*a*, 137*b* each define a cylinder or a polygonal prism, such that the thickness T4*a*, T4*b* is uniform along and about the longitudinal axis A5. It will be appreciated, however, that the inner surfaces 136*a*, 136*b* or outer surfaces 137*a*, 137*b* may define other shapes within the scope of the present disclosure, such that the thickness T4*a*, T4*b* varies along or about the longitudinal axis A5.

With reference to FIGS. 2, 3, and 4A, the insulator 24 may define a substantially cylindrical construct having a proximal end 140, a distal end 142, an inner surface 144, and an outer surface 146. The distal end 142 may be opposite the proximal end 140. The insulator 24 may be formed from one or more of a variety of materials, including, for example, a mineral wool, a steel wool, or other fibrous material.

As previously described, in the assembled configuration, expansion device 23 and the first inner sleeve 20*a* may be disposed within the housing 16. In this regard, the maximum diameter, or other similar dimension, defined by the outer surface 137*b* of the outer member 133*b* may be less than or equal to the diameter of the inner surface 30 of the housing 16. In this regard, the outer surface 137*b* of the outer member 133*b* and the inner surface 30 of the housing 16 may collectively define a passage 148 (FIG. 4B) extending from the proximal end 26 of the housing 16 to the distal end 135*b* of the outer member 133*b*. In some implementations, the maximum diameter, or other similar dimension, defined by the outer surface 137*b* of the outer member 133*b* and the diameter of the inner surface 30 of the housing 16 may be such that the passage 148 is defined by a width extending therebetween in a direction substantially perpendicular to the outer surface 137*b* and the inner surface 30. In some implementations, the width of the passage is less than or equal to one millimeter.

Similarly, the maximum diameter, or other similar dimension, defined collectively by the outer peaks 84, may be less than or equal to the diameter of the inner surface 30 of the housing 16. In some implementations, the maximum diameter defined collectively by the outer peaks 84 may be equal to the diameter of the inner surface 30 of the housing 16 such that the outer surface 72 of the first inner sleeve 20*a* engages the inner surface 30 of the housing 16 proximate to each of the peaks 84.

Similarly, as previously described, in the assembled configuration, the second inner sleeve 20*b* may be disposed within the first inner sleeve 20*a*. As illustrated in FIG. 4A, in some implementations, each peak 114 of the second inner sleeve 20*b* may be at least partially disposed within a corresponding trough 82 of the first inner sleeve 20*a*, while each peak 80 of the first inner sleeve 20*a* may be at least partially disposed within a corresponding trough 116 of the second inner sleeve 20*b*. In this regard, in some implementations, the maximum diameter defined collectively by the outer peaks 114 may be greater than the minimum diameter defined collectively by the inner peaks 80 of the first inner sleeve 20*a*. It will be appreciated, however, that in other configurations, the maximum diameter defined collectively by the outer peaks 114 may be less than or equal to the minimum diameter defined collectively by the inner peaks 80 of the first inner sleeve 20*a*. For example, the maximum diameter defined collectively by the outer peaks 114 may be equal to the minimum diameter defined collectively by the inner peaks 80 of the first inner sleeve 20*a* such that the outer surface 102 of the second inner sleeve 20*b* engages the inner surface 70 of the first inner sleeve 20*a* proximate to each of the peaks 80, 114.

In some implementations, the first inner sleeve 20*a* and the expansion device 23 are concentrically disposed within the housing 16, and the second inner sleeve 20*b* is concentrically disposed within the first inner sleeve 20*a*, such that the longitudinal axis A1 is aligned with the longitudinal axes A2, A5 and the longitudinal axes A2, A5 are aligned with the longitudinal axis A3.

With reference to FIG. 3, the baffle(s) 22 may be disposed within the housing 16 such that (i) the outer surface 130 of the baffle 22 engages the inner surface 30 of the housing 16, (ii) the distal ends 135*a*, 135*b* of the inner and outer members 133*a*, 133*b*, respectively, engage the proximal end 124 of the baffle 22, (iii) the distal ends 68, 98 of the first and second inner sleeves 20*a*, 20*b*, respectively, engage the proximal end 124 of the baffle 22, and (iv) the proximal ends 66, 96 of the first and second inner sleeves 20*a*, 20*b*, respectively, engage the distal end 126 of the baffle 22. In some implementations, the inner or outer members 133*a*, 133*b* or the first or second inner sleeves 20*a*, 20*b* may be fastened to (e.g., adhesive, welding, etc.), or monolithically formed with, one or more of the baffles 22.

As illustrated in FIG. 3, in some implementations, the suppressor 14 includes three baffles 22 such that suppressor 14 defines (i) a first expansion chamber or sound-suppressing region 150*a* between a first baffle 22*a* and the proximal end 26 of the housing 16, (ii) a second sound-suppressing region 150*b* between the first baffle 22*a* and a second baffle 22*b*, (iii) a third sound-suppressing region 150*c* between the second baffle 22*b* and the third baffle 22*c*, and (iv) a fourth sound-suppressing region 150*d* between the third baffle 22*c* and the distal end 28 of the housing 16. It will be appreciated, however, that the suppressor 14 may include more or less than three baffles 22, such that the suppressor 14 defines more or less than four sound-suppressing regions 150*a*, 150*b*, 150*c*, 150*d* within the scope of the present disclosure.

The insulator 24 may be disposed within one or both of the housing 16 and the endcap 18. For example, in some implementations, a first portion of the insulator 24 is disposed within the housing 16 and a second portion of the insulator 24 is disposed within the endcap 18. In particular, the first portion of the insulator 24 may be disposed within the endcap 18 such that (i) the outer surface 146 engages the inner surface 48 of the endcap 18 and (ii) the proximal end 140 is aligned (e.g., coplanar or flush) with the proximal end 44 of the endcap 18. The second portion of the insulator 24 may be disposed within the housing 16 such that (i) the outer surface 146 engages the inner surface 100 of the second inner sleeve 20*b* and (ii) the distal end 142 abuts one of the baffles 22.

Figure 5:
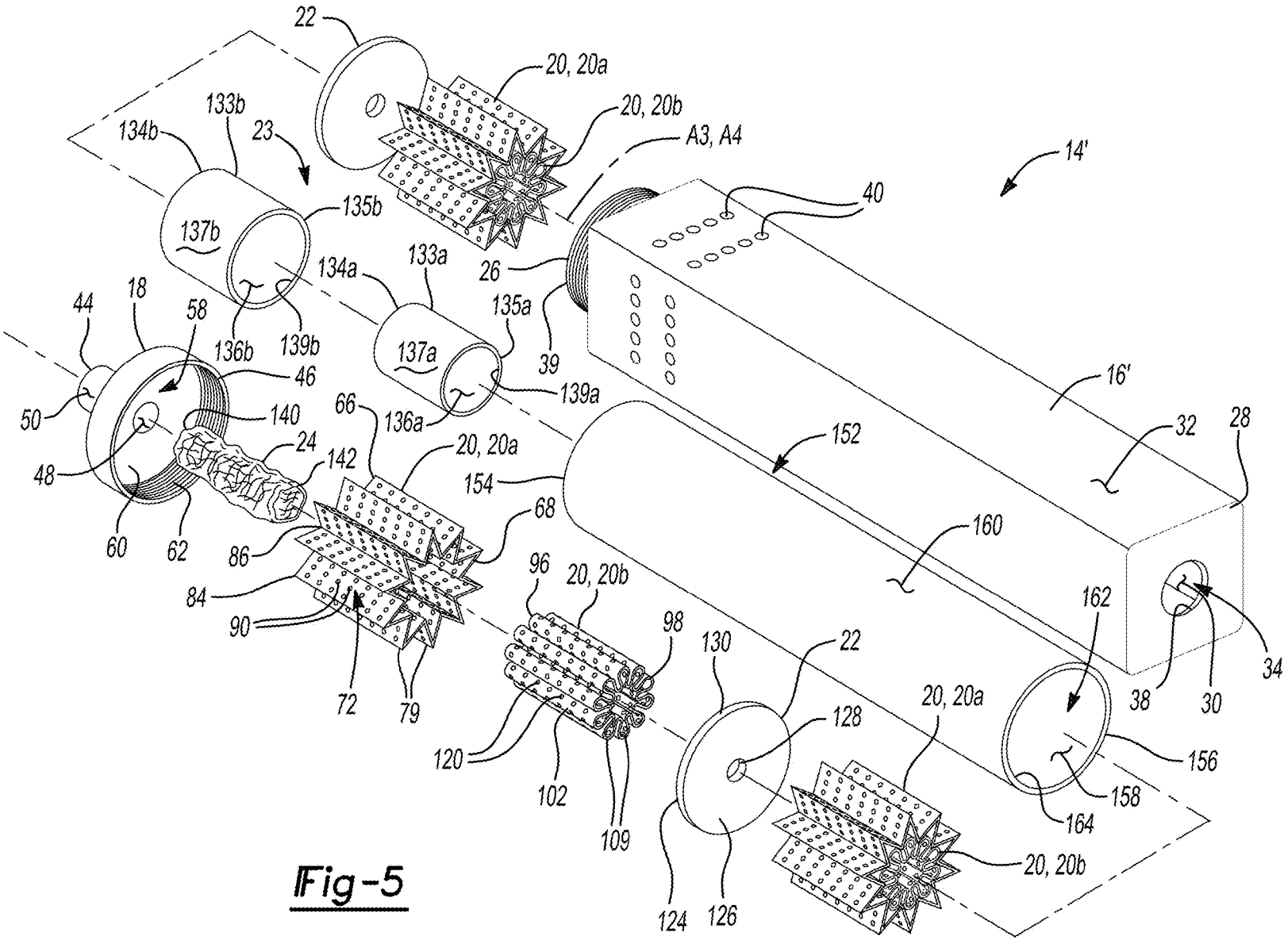
FIG. 5 is an exploded view of another sound suppressor in accordance with the principles of the present disclosure.
Figure 6:
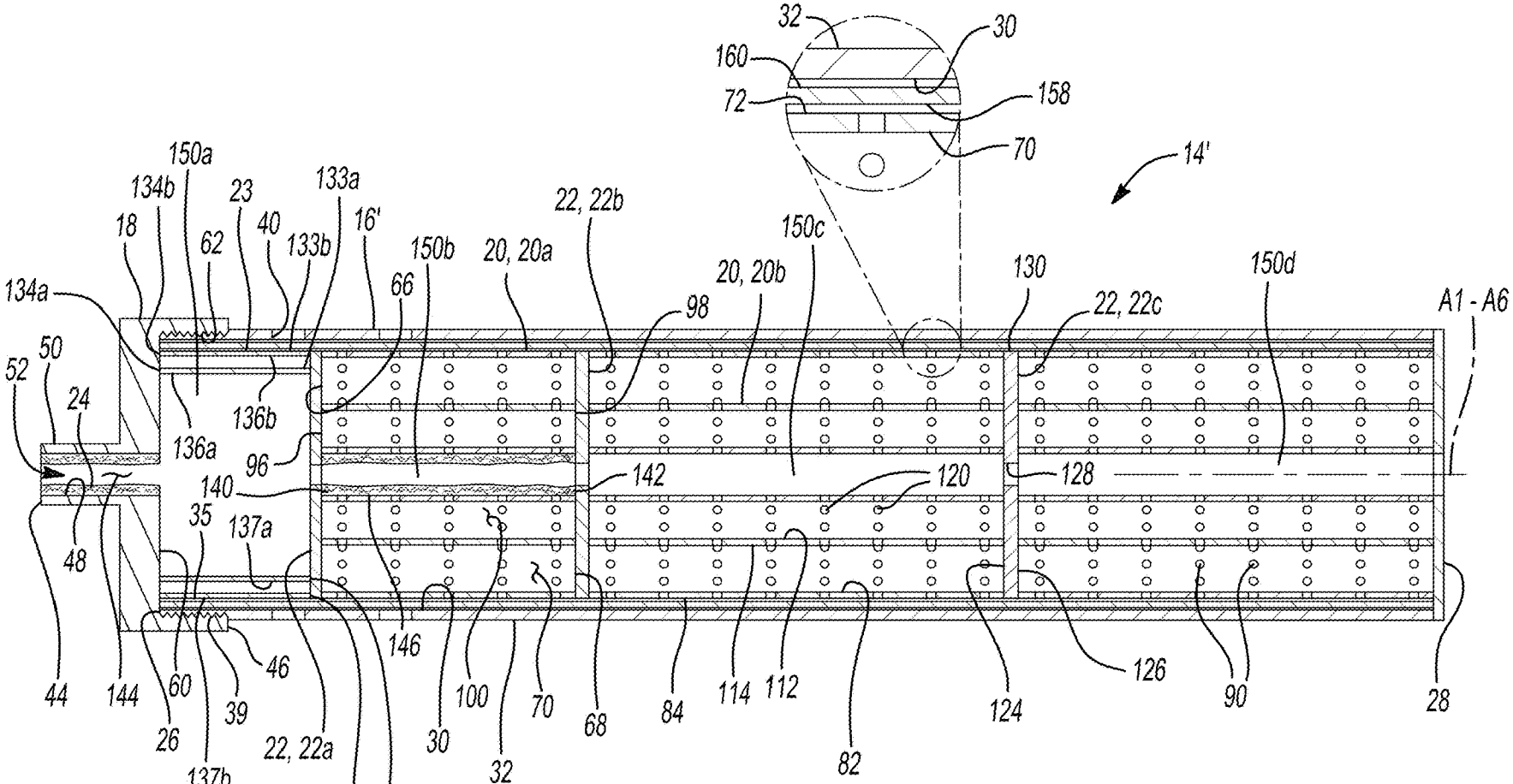
FIG. 6 is a cross-sectional view of the sound suppressor of FIG. 5, similar to the cross-sectional view of the sound suppressor of FIG. 1 illustrated in FIG. 3.

With reference to FIGS. 5 and 6, another sound suppressor 14' is shown. The structure and function of the sound suppressor 14' may be substantially similar to that of the sound suppressor 14, apart from any exceptions described herein or shown in the Figures. Accordingly, the structure and/or function of similar features will not be described in detail. In addition, like reference numerals are used in the drawings to identify like features, while like reference numerals containing extensions (i.e., "'") are used to identify those features that have been modified.

The sound suppressor 14' may include a housing 16', the endcap 18, one or more inner sleeves 20, one or more baffles 22, the expansion device 23, the insulator 24, and an intermediate shell 152. The housing 16' may define a square or rectangular prism extending along and about the longitudinal axis A1. The shell 152 may extend along a longitudinal axis A6 and include a proximal end 154, a distal end 156, an inner surface 158, and an outer surface 160. The distal end 156 may be opposite the proximal end 154. The shell 152 may be formed from one or more of a variety of materials, including, for example, aluminum, steel, or another suitable metal material.

As illustrated in FIG. 6, the inner surface 158 and the outer surface 160 may surround and extend along the longitudinal axis A6 from the proximal end 154 to the distal end 156, such that the inner surface 158 defines a passage 162 extending through the shell 152 from the proximal end 154 to the distal end 156.

The proximal end 154 may define an entrance opening, while the distal end 156 may define an exit opening 164. In this regard, the entrance opening may be in fluid communication with the exit opening 164 through the passage 162.

In the assembled configuration, the shell 152 may be disposed within (e.g., concentrically) the housing 16' such that the proximal end 154 abuts the endcap 18, and the distal end 156 abuts the distal end 28 of the housing 16'. The outer surface 130 of the baffles 22 may engage the inner surface 158 of the shell 152.

With reference to FIGS. 7-11, another sound suppressor 14" is shown. The structure and function of the sound suppressor 14" may be substantially similar to that of the sound suppressors 14, 14', apart from any exceptions described herein or shown in the Figures. Accordingly, the structure and/or function of similar features will not be described in detail. In addition, like reference numerals are used in the drawings to identify like features, while like reference numerals containing extensions (i.e., "'") are used to identify those features that have been modified.

The sound suppressor 14" may include a housing 16", the endcap 18, one or more of the inner sleeves 20, one or more of the baffles 22, the insulator 24, an intermediate shell assembly 152", and a door assembly 178. In this regard, while the suppressor 14" is generally shown to include multiple inner sleeves 20*a* and baffles 22, it will be appreciated that the suppressor 14" may include one inner sleeve 20*a* and no baffles 22 within the scope of the present disclosure, such that a single sleeve 20*a* extends from the proximal end 26 of the housing 16" to the distal end 28 of the housing 16".

The shell assembly 152" may extend along the longitudinal axis A6 and include an inner shell or member 180*a*, an outer shell or member 180*b*, and an intermediate member 180*c*. As illustrated, the inner, outer, and intermediate members 180*a*, 180*b*, 180*c* may be integrally formed. For example, in some implementations, the shell assembly 152" is a unitary, monolithic piece formed from the inner, outer, and intermediate members 180*a*, 180*b*, 180*c*. In this regard, the shell assembly 152", including each of the inner, outer, and intermediate members 180*a*, 180*b*, 180*c*, may be formed from one or more of a variety of materials, including, for example, aluminum, steel, or another suitable metal material. In some implementations, the shell assembly 152" may form an acoustic metamaterial construct configured to deviate the soundwaves transmitted through the shell assembly 152" and reduce the volume of sound produced by such soundwaves. In particular, the inner, outer, and intermediate members 180*a*, 180*b*, 180*c* may be formed from, or other otherwise define, a material or construct configured to control, direct, and manipulate sound waves. For example, each of the inner, outer, and intermediate members 180*a*, 180*b*, 180*c* may be formed from an acoustic metamaterial configured to deviate the soundwaves transmitted through the inner member 180*a* and reduce the volume of sound produced by such soundwaves.

Figure 9A:
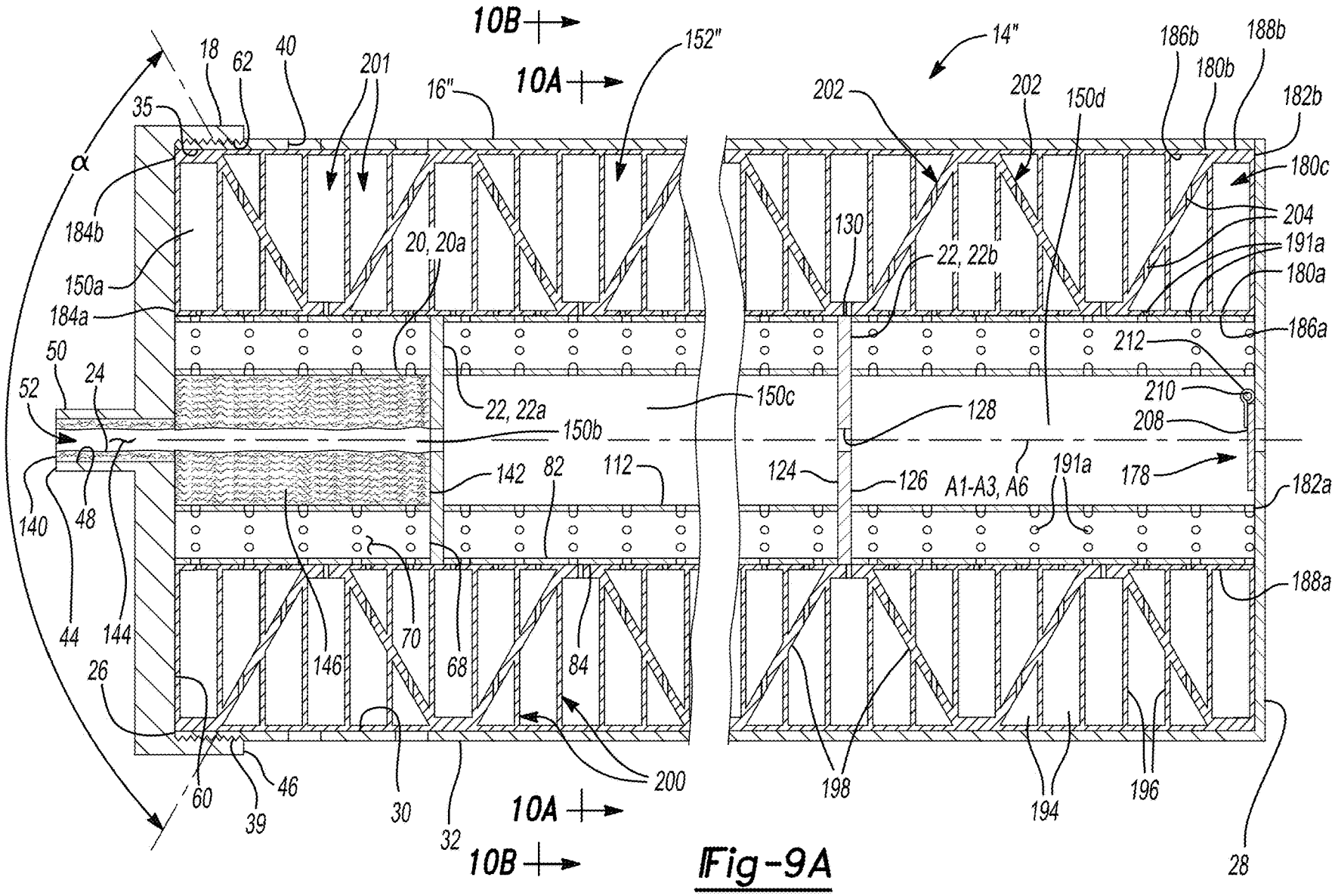
FIG. 9A is a cross-sectional view of the sound suppressor of FIG. 7, similar to the cross-sectional view of the sound suppressor of FIG. 1 illustrated in FIG. 3, showing a door assembly in a closed position.
Figure 9B:
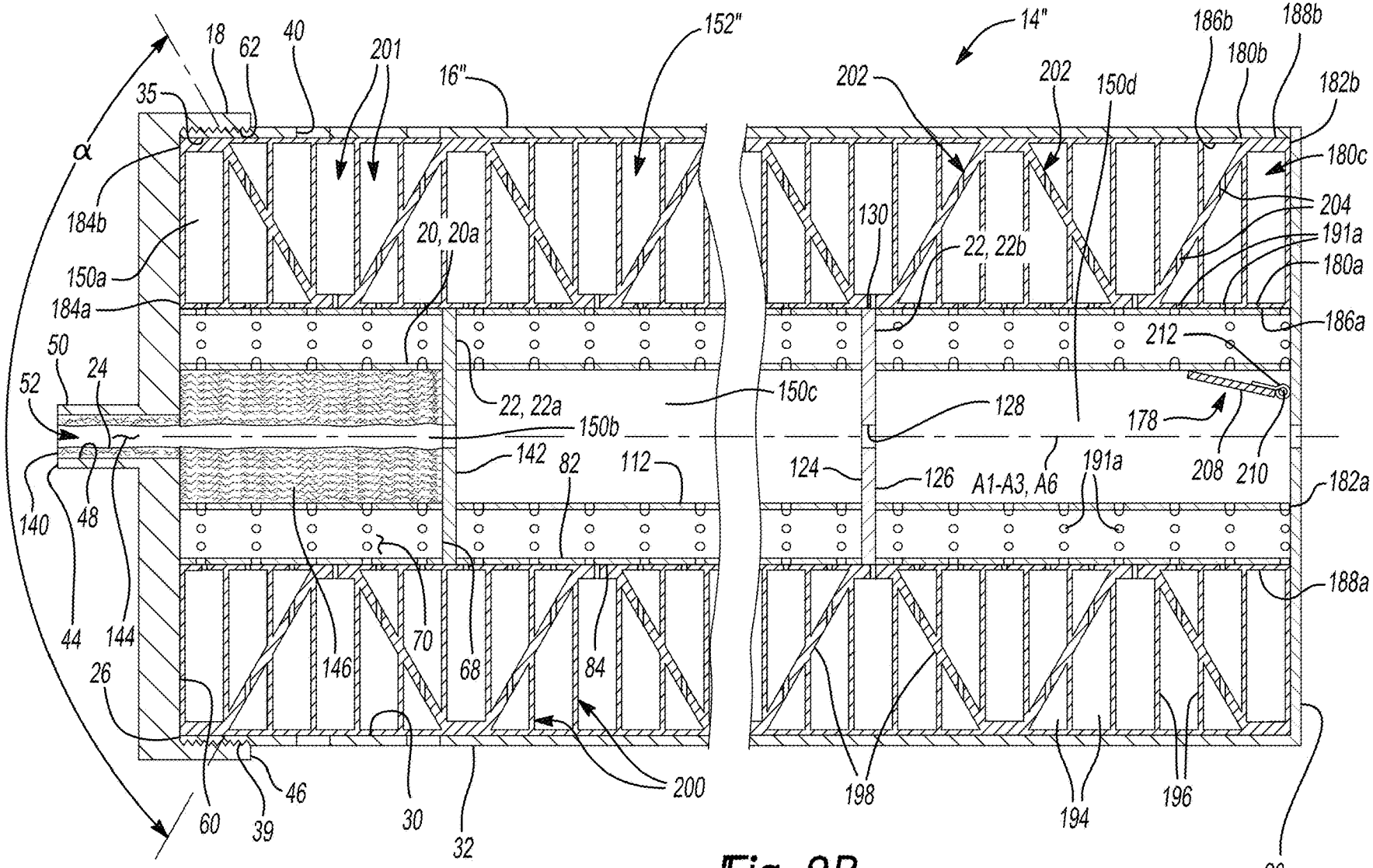
FIG. 9B is a cross-sectional view of the sound suppressor of FIG. 7, similar to the cross-sectional view of the sound suppressor of FIG. 1 illustrated in FIG. 3, showing the door assembly in an open position.
Figure 10A:
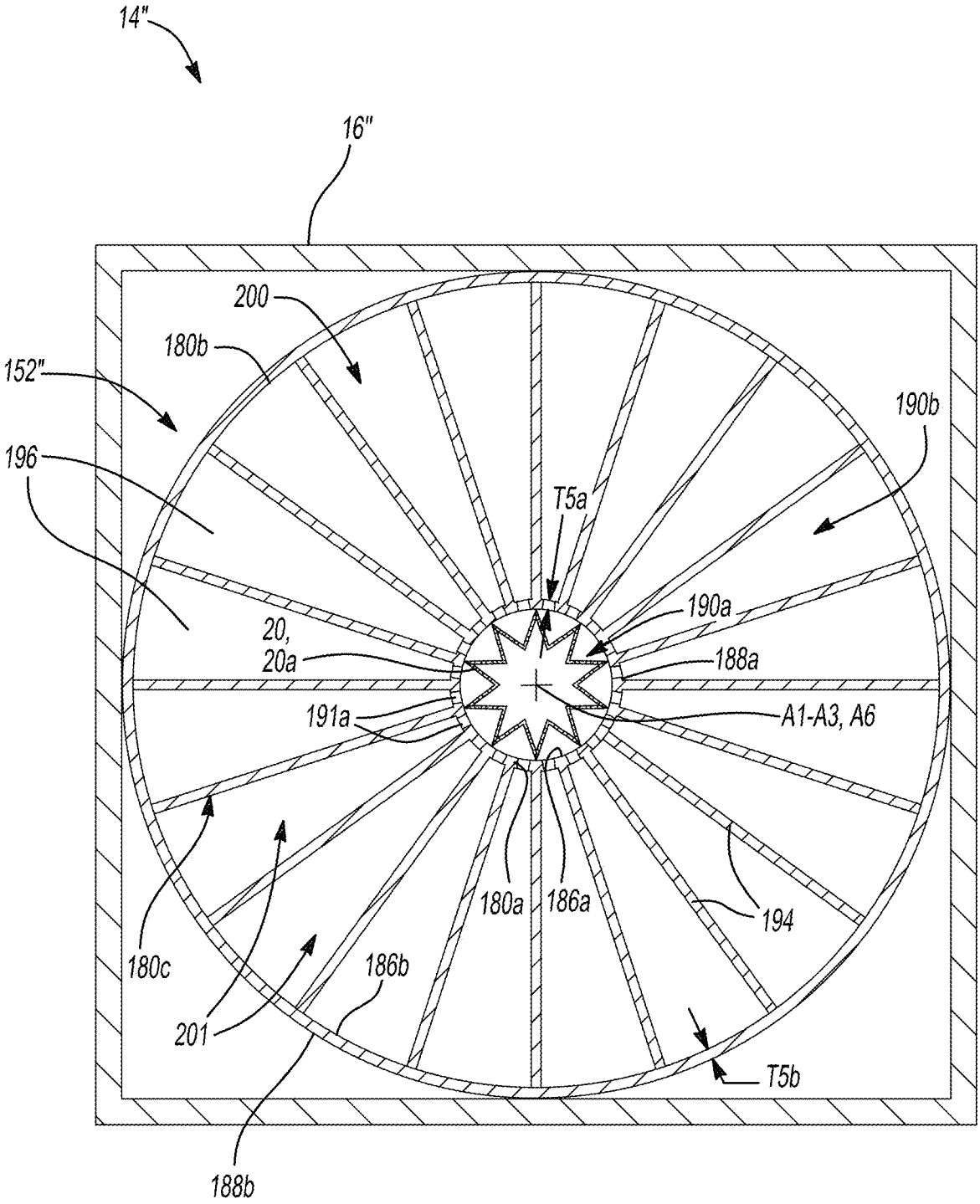
FIG. 10A is a cross-sectional view of the sound suppressor of FIG. 7, similar to the cross-sectional view of the sound suppressor of FIG. 1 illustrated in FIG. 4A, and taken along the line 10A-10A of FIG. 9A.
Figure 10B:
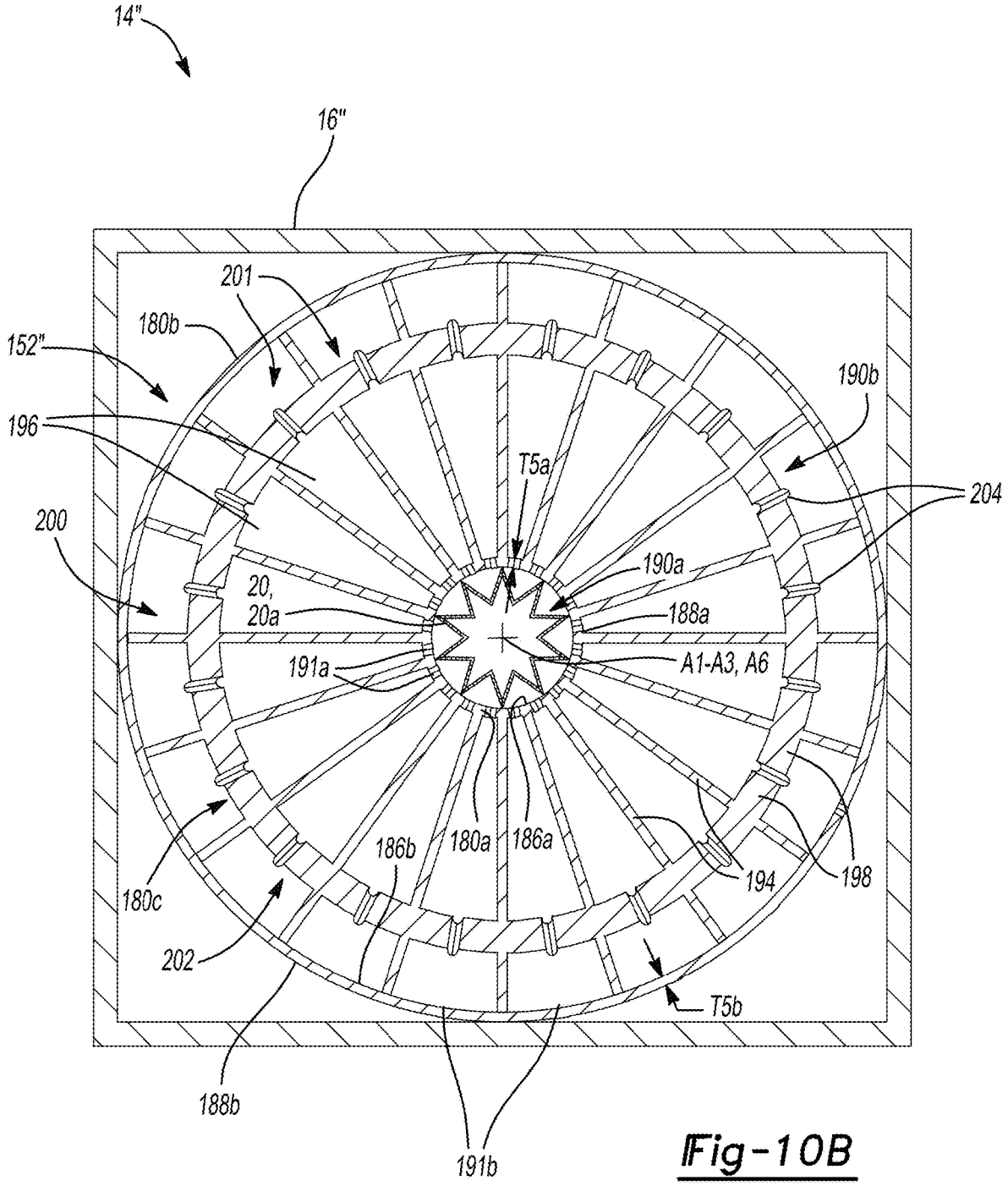
FIG. 10B is a cross-sectional view of the sound suppressor of FIG. 7, similar to the cross-sectional view of the sound suppressor of FIG. 1 illustrated in FIG. 4A, and taken along the line 10B-10B of FIG. 9A.

The inner and outer members 180*a*, 180*b* may each include, respectively, a proximal end 182*a*, 182*b*, a distal end 184*a*, 184*b*, an inner surface 186*a*, 186*b*, and an outer surface 188*a*, 188*b*. The distal ends 184*a*, 184*b* may be opposite the proximal ends 182*a*, 182*b*, respectively. As illustrated in FIGS. 9A and 9B, the inner surfaces 186*a*, 186*b* and the outer surfaces 188*a*, 188*b* may surround and extend along the longitudinal axis A6 from the proximal end 182*a*, 182*b* to the distal end 184*a*, 184*b*, respectively, such that the inner surfaces 186*a*, 186*b* and outer surfaces 188*a*, 188*b* define thicknesses T5*a*, T5*b*, respectively, (FIG. 10A) extending therebetween in a direction substantially perpendicular to the inner surfaces 186*a*, 186*b* and outer surfaces 188*a*, 188*b*. Accordingly, the inner surface 186*a* of the inner member 180*a* may define a passage 190*a* extending therethrough from the proximal end 182*a* to the distal end 184*a*, while the inner surface 186*b* of the outer member 180*b* may define a passage 190*b* extending therethrough from the proximal end 182*a* to the distal end 184*a*. As illustrated in FIGS. 10A and 10B, the inner member 180*a* may be disposed within (e.g., concentrically) the outer member 180*b* such that the passage 190*b* is defined by the outer surface 188*a* of the inner member 180*a* and the inner surface 186*b* of the outer member 180*b*.

The inner member 180*a* may define a plurality of perforations or apertures 191*a* extending through the inner surface 186*a* and outer surface 188*a*. In some implementations, the apertures 191*a* define a circular or cylindrical shape extending through the inner surface 186*a* and outer surface 188*a*. In this regard, the apertures 191*a* may define a diameter greater than 0.75 millimeters. In particular, the apertures 191*a* may define a diameter greater than 1.0 millimeter. The apertures 191*a* may collectively define one or more patterns extending along or about the longitudinal axis A6. For example, as illustrated in FIGS. 9A-10B, in some implementations, the apertures 191*a* define a plurality of circular patterns surrounding, and spaced (e.g., equally spaced) along, the axis A6.

Figure 7:
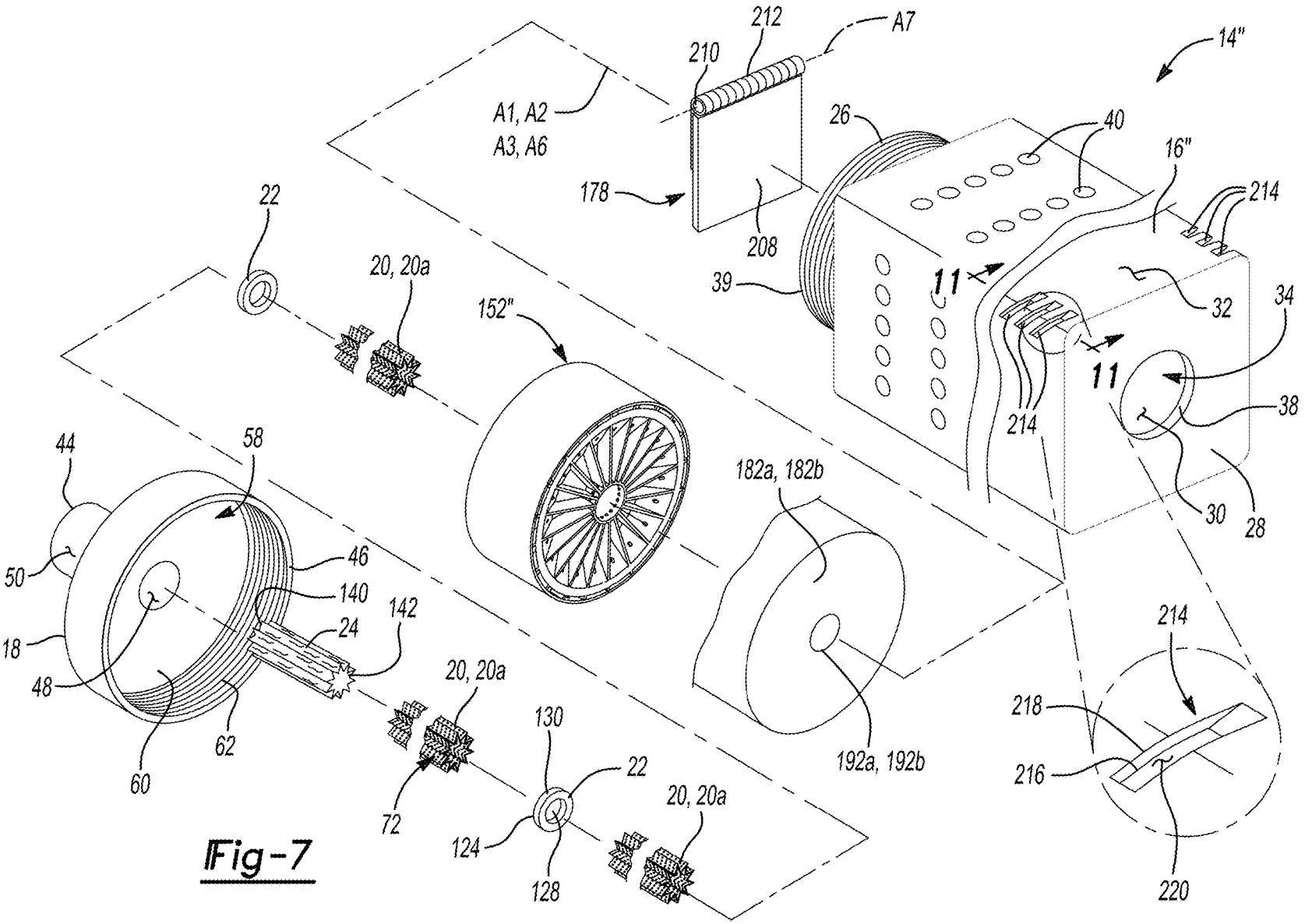
FIG. 7 is an exploded view of another sound suppressor in accordance with the principles of the present disclosure.
Figure 8:
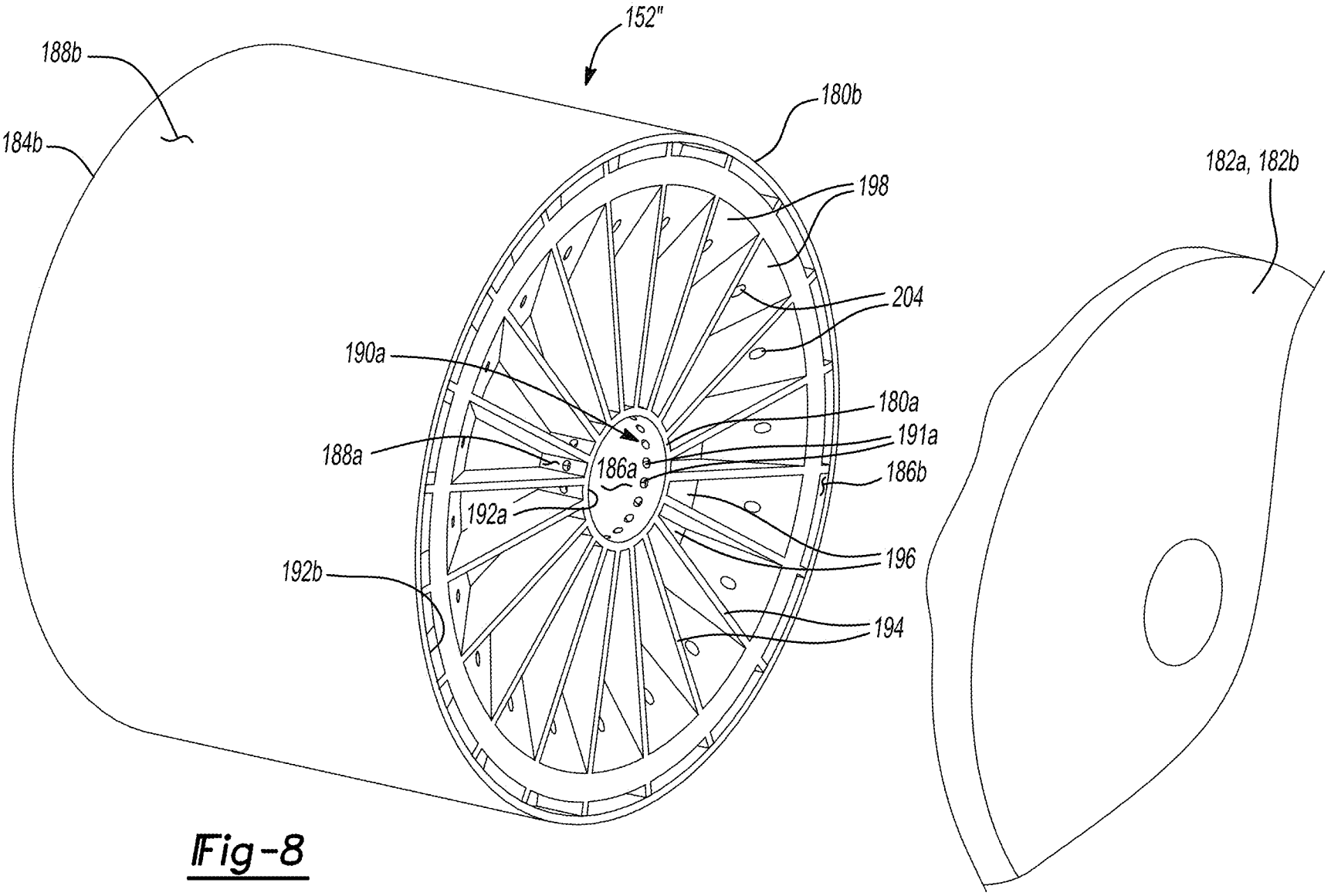
FIG. 8 is perspective view of a shell assembly of the sound suppressor of FIG. 7 in accordance with the principles of the present disclosure.

As illustrated in FIG. 7, the proximal end 182*a*, 182*b* of the inner and outer members 180*a*, 180*b*, respectively, may define an entrance opening, while the distal end 184*a*, 184*b* of the inner and outer members 180*a*, 180*b*, respectively, may define an exit opening 192*a*, 192*b*. In this regard, the entrance opening may be in fluid communication with the exit opening 192*a*, 192*b* through the passage 190*a*, 190*b*, respectively.

In some implementations, the inner surfaces 186*a*, 186*b* and the outer surfaces 188*a*, 188*b* each define a cylinder or a polygonal prism, such that the thickness T5*a*, T5*b* is uniform along and about the longitudinal axis A6. It will be appreciated, however, that the inner surfaces 186*a*, 186*b* or outer surfaces 188*a*, 188*b* may define other shapes within the scope of the present disclosure, such that the thickness T5*a*, T5*b* varies along or about the longitudinal axis A6.

The intermediate member 180*c* may be disposed within the housing 16". For example, the intermediate member 180*c* may be disposed within the passage 190*b* of the outer member 180*b* and extend from the proximal ends 182*a*, 182*b* to the distal ends 184*a*, 184*b* of the inner and outer members 180*a*, 180*b*. In particular, the intermediate member 180*c* may be disposed between the inner and outer members 180*a*, 180*b*, such that the intermediate member 180*c* engages the outer surface 188*a* of the inner member 180*a* and the inner surface 186*b* of the outer member 180*b*.

As illustrated in FIG. 7, the intermediate member 180*c* may include a plurality of first fins 194, a plurality of second fins 196, and a plurality of third fins 198. As illustrated in FIG. 9A, the fins 194 may each extend in a direction substantially (+/−5 degrees) parallel to the longitudinal axis A6 from the proximal end 26 of the housing 16" to the distal end 28 of the housing 16". As illustrated in FIGS. 10A and 10B, the fins 194 may be equally-spaced about the axis A6 and extend radially in a direction substantially (+/−5 degrees) perpendicular to the inner and outer members 180*a*, 180*b*. In particular, the fins 194 may abut, and extend perpendicularly from, the outer surface 188*a* of the inner member 180*a* and the inner surface 186*b* of the outer member 180*b*. While the intermediate member 180*c* is generally shown and described herein as including twenty fins 194, the intermediate member 180*c* may include more or less than twenty fins within the scope of the present disclosure.

With reference to FIG. 7, the fins 196 may extend in a direction substantially (+/−5 degrees) perpendicular to the longitudinal axis A6 and substantially (+/−5 degrees) perpendicular to the fins 194. In particular, each fin 196 may extend from and between adjacent ones of the fins 194, such that a plurality of fins 196 surround the longitudinal axis A6. In this regard, as illustrated in FIGS. 10A and 10B, the fins 196 may form a plurality of circular-shaped patterns 200 surrounding the axis A6. As illustrated in FIGS. 9A and 9B, the circular-shaped patterns 200 may be equally-spaced along the axis A6. As further illustrated in FIGS. 10A and 10B, the fins 196 may further extend radially in a direction substantially (+/−5 degrees) perpendicular to the inner and outer members 180*a*, 180*b*. In particular, the fins 196 may abut, and extend perpendicularly from, (i) the outer surface 188*a* of the inner member 180*a* and the inner surface 186*b* of the outer member 180*b*, and (ii) adjacent fins 194. Accordingly, the fins 194, 196 may define a plurality of chambers 201 between the inner and outer members 180*a*, 180*b*.

With reference to FIG. 7, the fins 198 may extend between adjacent pairs of the fins 194, between adjacent pairs of the fins 196, or between the inner and outer members 180*a*, 180*b*. In particular, each fin 198 may extend from a first of the fins 194 to a second of the fins 194 and from a first of the fins 196 to a second of the fins 196, such that a plurality of fins 198 surround the longitudinal axis A6 and extend through one or more of the chambers 201. In this regard, as illustrated in FIGS. 10A and 10B, the fins 198 may form a plurality of frustoconically-shaped constructs 202 surrounding the axis A6. In this regard, each frustoconically-shaped construct 202 may define a circular shape in a cross-section taken perpendicular to the axis A6, as illustrated in FIGS. 10A and 10B. In some implementations, each fin 198 extends between the inner and outer members 180*a*, 180*b* such that the frustoconically-shaped constructs 202 define an apex angle α. The apex angle a may be between five degrees and one hundred seventy degrees. In some implementations, the apex angle a may be substantially equal to one hundred fifteen degrees. The frustoconically-shaped constructs 202 may be equally-spaced along the axis A6 to define a corrugated construct disposed between the inner and outer members 180*a*, 180*b*. In particular, the apex angles a of the frustoconically-shaped constructs 202 may alternate such that the apex angles a of consecutive frustoconically-shaped constructs 202 face in opposite directions. For example, the apex angle a of a first of the frustoconically-shaped constructs 202 may face the proximal end 182*a* of the inner member 180*a*, while the apex angle a of a second of the frustoconically-shaped constructs 202, adjacent the first of the frustoconically-shaped constructs 202, faces the distal end 182*b* of the inner member 180*a*. In some implementations, the apex (e.g., the smallest diameter) of a first of the frustoconically-shaped constructs 202 is adjacent the apex (e.g., the smallest diameter) of a second of the frustoconically-shaped constructs 202, while the base (e.g., the largest diameter) of the first of the frustoconically-shaped constructs 202 is adjacent the base (e.g., the largest diameter) of the second of the frustoconically-shaped constructs 202.

Each fin 198 may include one or more perforations or apertures 204 extending therethrough. In particular, the apertures 204 may define a circular or cylindrical shape extending through the fins 198. In this regard, the apertures 204 may define a diameter greater than 0.75 millimeters. In particular, the apertures 204 may define a diameter greater than 1.0 millimeter. As illustrated in FIGS. 9A and 9B, each aperture 204 may be in fluid communication with a chamber 201. In this regard, each fin 198 may extend through one or more of the chambers 201 to define an inner and outer portion thereof. Each aperture 204 may be in fluid communication with the inner and outer portions of the chamber 201, such that the apertures 191*a* are in fluid communication with the chambers 201 through the apertures 204.

As previously described, the fins 194, 196, or 198 may define, or otherwise be formed at least in part from, a material or construct configured to control, direct, and manipulate sound waves. For example, the fins 194, 196, or 198 may be formed from, or otherwise define, an acoustic metamaterial configured to deviate the soundwaves transmitted through the intermediate member 180*c* and reduce the volume of sound produced by such soundwaves.

With reference to FIGS. 9A and 9B, the door assembly 178 may be disposed within the housing 16" and pivotally supported by one of the housing 16" or the intermediate shell assembly 152" for rotation about an axis A7 between an open or resting position (FIG. 9B) and a closed or active position (FIG. 9A). As illustrated, the axis A7 may extend in a direction transverse (e.g., orthogonal) to the axis A1. In this regard, as illustrated in FIG. 7, the door assembly 178 may include a door 208, a hinge 210, and a biasing member 212. In some implementations, the door 208 is pivotally coupled to the housing 16" via the hinge 210 for rotation about the axis A7. For example, in some implementations, the door 208 may be pivotally coupled to the inner surface 30 of the housing 16" proximate the distal end 28. In the open position, the door 208 does not block the opening 38 relative to the axis A1, while in the closed position, the door 208 does block the opening 38 relative to the axis A1. In particular, in the open position, the axis A1 does not intersect the door 208, while in the closed position, the the axis A1 does intersect the door 208. As will be explained in more detail below, during use, the biasing member 212 may bias the door 208 from the closed position into the open position (e.g., in a clockwise direction relative to the view in FIGS. 9A and 9B) such that the door 208 does not block the opening 38 and the axis A1 does not intersect the door 208. In this regard, while the biasing member 212 is generally shown and described herein as being a helical torsion spring, it will be appreciated that the biasing member may include other forms (e.g., a compression spring, a piston, an elastic member, etc.) within the scope of the present disclosure.

Figure 11:
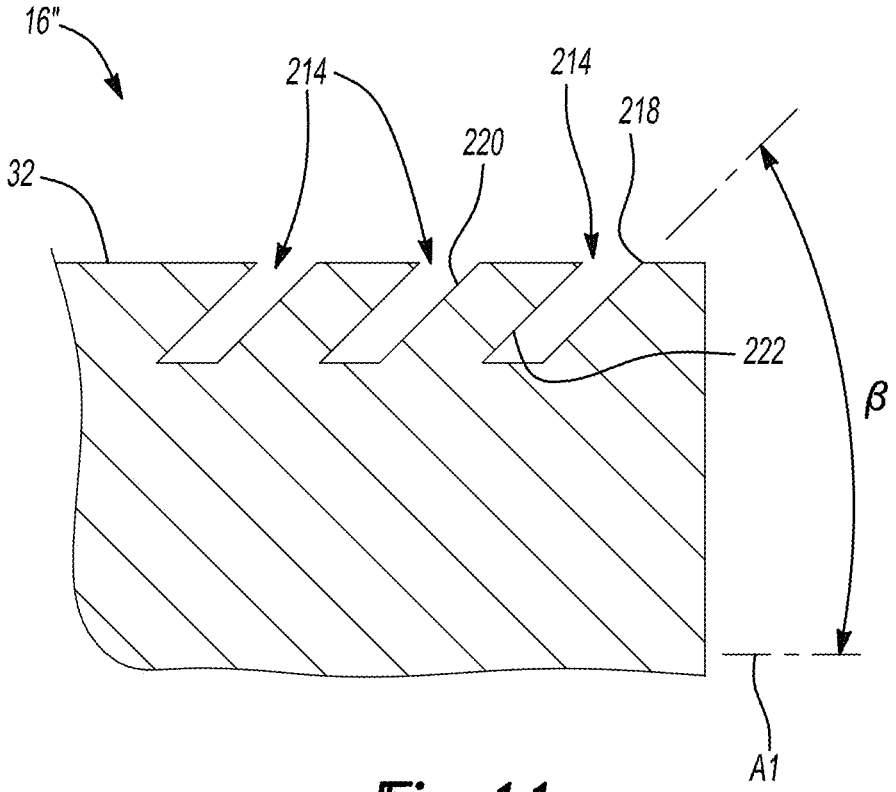
FIG. 11 is a partial cross-sectional view of a housing of the sound suppressor of FIG. 7, taken along the line 11-11 of FIG. 7.

The housing 16" may be substantially similar to the housing 16' except as otherwise shown and described herein. As illustrated in FIGS. 7 and 11, the housing 16" may include a plurality of vents 214. The vents 214 may extend through the inner and outer surfaces 30, 32 of the housing 16" such that the inner surface 30 includes an inlet opening 216, and the outer surface 32 includes an outlet opening 218. As illustrated in FIG. 11, the vents 214 may be disposed at an angle β relative to the axis A1. For example, the vents 214 may be defined in part by opposed surfaces 220, 222. The surfaces 220, 220 may extend from the inlet 216 to the outlet 218 and be disposed at the angle β relative to the axis A1 such that the outlet 218 is disposed between the inlet 216 and the end 28 of the housing 16" relative to the axis A1.

With reference to FIGS. 12-14B, another intermediate shell assembly 152" for use with a sound suppressor 14, 14', 14", 14'" is shown. The structure and function of the intermediate shell assembly 152" may be substantially similar to that of the intermediate shell assembly 152", apart from any exceptions described herein or shown in the Figures. Accordingly, the structure and/or function of similar features will not be described in detail. In addition, like reference numerals are used in the drawings to identify like features, while like reference numerals containing extensions (i.e., "'") are used to identify those features that have been modified.

Figure 14A:
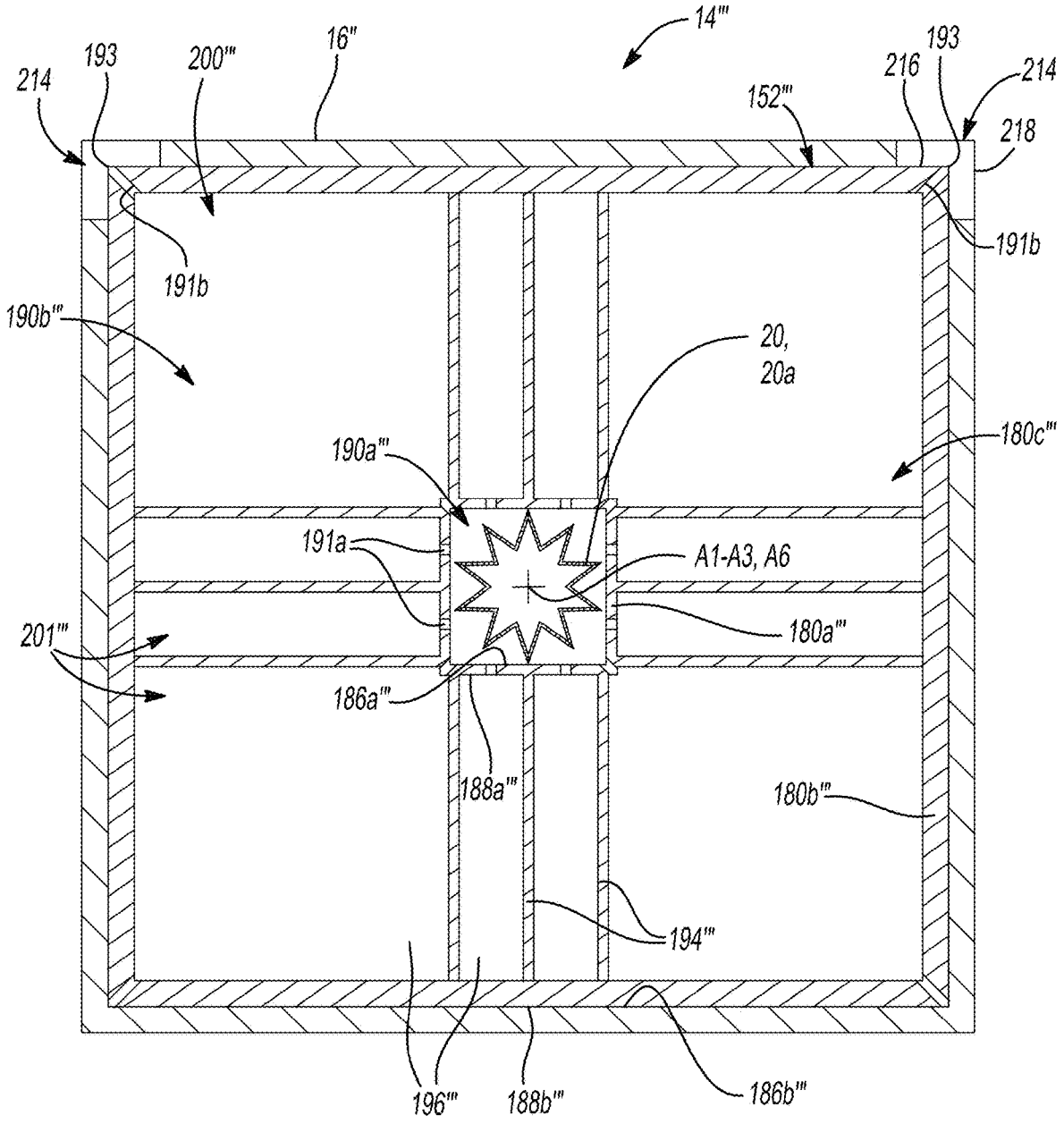
FIG. 14A is a cross-sectional view of the sound suppressor of FIG. 7 including the shell assembly of FIG. 12, similar to the cross-sectional view of the sound suppressor of FIG. 7 illustrated in FIG. 10A, and taken along the line 14A-14A of FIG. 13A.
Figure 14B:
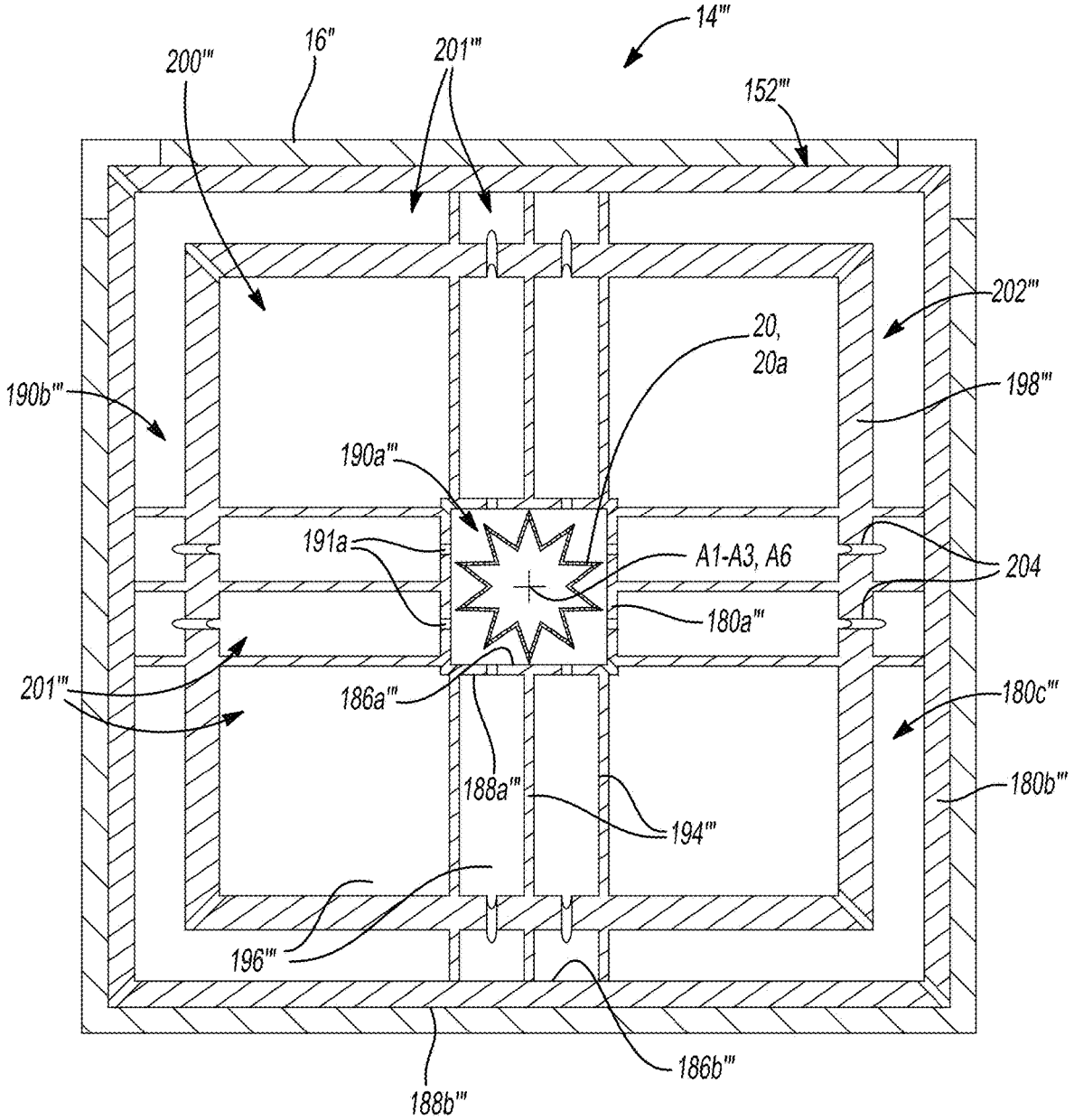
FIG. 14B is a cross-sectional view of the sound suppressor of FIG. 7 including the shell assembly of FIG. 12, similar to the cross-sectional view of the sound suppressor of FIG. 7 illustrated in FIG. 10B, and taken along the line 14B-14B of FIG. 13A.

The shell assembly 152'" may extend along the longitudinal axis A6 and include an inner shell or member 180*a*'", an outer shell or member 180*b*'", and an intermediate member 180*c*'". The structure and function of the inner member 180*a*'", the outer member 180*b*'", and the intermediate member 180*c*'" may be substantially similar to that of the inner member 180*a*, the outer member 180*b*, and the intermediate member 180*c*, respectively, apart from any exceptions described herein or shown in the Figures. Accordingly, the structure and/or function of similar features will not be described in detail. As illustrated in FIGS. 14A and 14B, the inner member 180*a*'" and the outer member 180*b*'" may each define a substantially rectangular (e.g., square) shaped cross section surrounding, and extending along, the axis A6. In particular, the proximal end 182*a*'", 182*b*'", distal end 184*a*'", 184*b*'", inner surface 186*a*'", 186*b*'", and outer surface 188*a*'", 188*b*'" may each define a rectangular shape extending along, and about, the axis A6, such that the inner surface 186*a*'" of the inner member 180*a*'" may define a passage 190*a*'" extending therethrough from the proximal end 182*a*'" to the distal end 184*a*'", while the inner surface 186*b*'" of the outer member 180*b*'" may define a passage 190*b*'" extending therethrough from the proximal end 182*a*'" to the distal end 184*a*'". As illustrated in FIGS. 14A and 14B, the inner member 180*a*'" may be disposed within (e.g., concentrically) the outer member 180*b*'" such that the passage 190*b*'" is defined by the outer surface 188*a*'" of the inner member 180*a*'" and the inner surface 186*b*'" of the outer member 180*b*'".

With reference to at least FIGS. 12-14B, the outer member 180*b*'" may include a plurality of vents or apertures 191*b*, while the inner member 180*a*'" may include the apertures 191*a*. The apertures 191*b* may be disposed adjacent to or along an intersection 193 of two sides of the outer member 180*b*'". For example, a first plurality of the apertures 191*b* may be disposed along a first intersection of a first side of the outer member 180*b*'" and a second side of the outer member 180*b*'", and a second plurality of the apertures 191*b* may be disposed along a second intersection of the first side of the outer member 180*b*'" and a third side of the outer member 180*b*'", such that the first plurality of apertures 191*b* defines a first line and the second plurality of apertures 191*b* defines a second line that is parallel to the first line and to the axis A6. The apertures 191*a* may collectively define one or more patterns extending along or about the longitudinal axis A6. For example, as illustrated in FIGS. 13A-14B, in some implementations, the apertures 191*a* define a plurality of rectangular patterns surrounding, and spaced (e.g., equally spaced) along, the axis A6.

Figure 12:
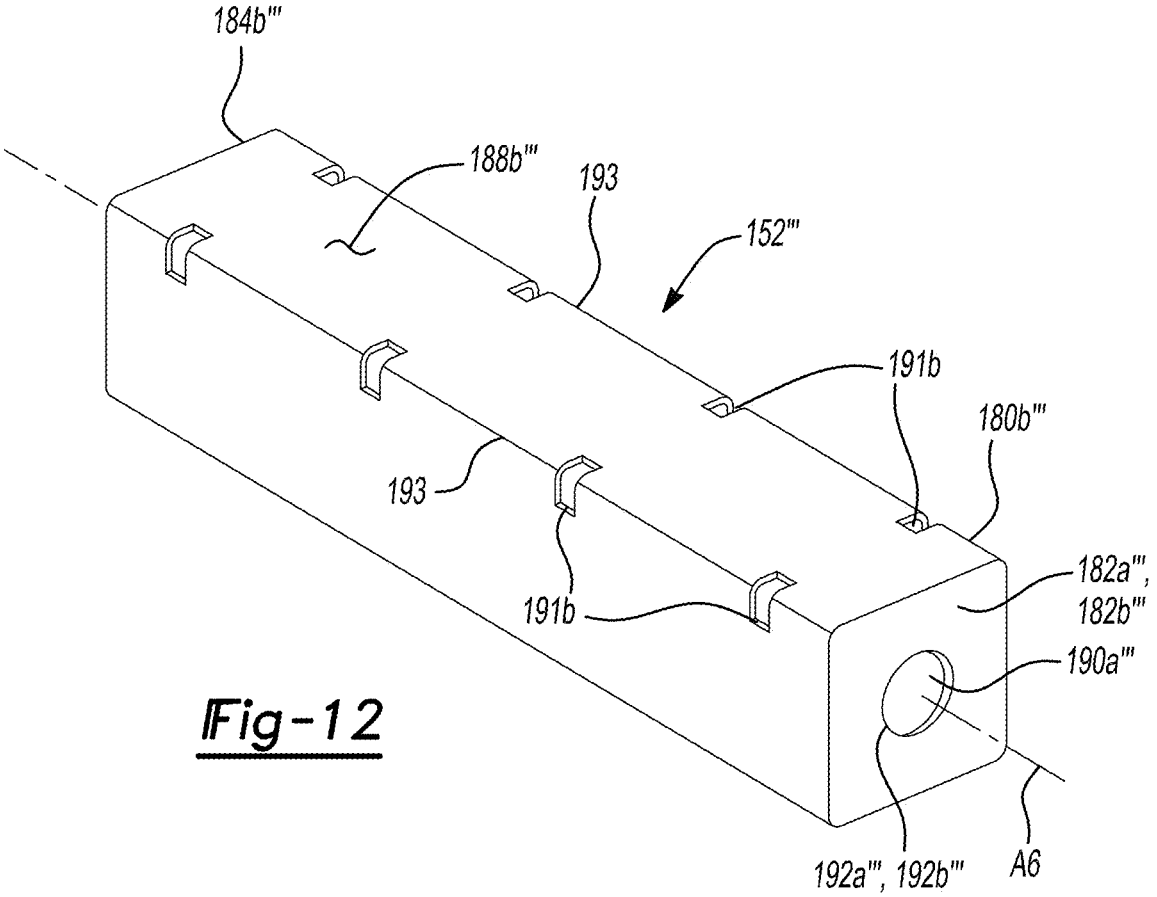
FIG. 12 is perspective view of another shell assembly for use with the sound suppressor of FIG. 7 in accordance with the principles of the present disclosure.

As illustrated in FIG. 12, the proximal end 182*a*'", 182*b*'" of the inner and outer members 180*a*'", 180*b*'", respectively, may define an entrance opening, while the distal end 184*a*'", 184*b*'" of the inner and outer members 180*a*'", 180*b*'", respectively, may define an exit opening 192*a*'", 192*b*'". In this regard, the entrance opening may be in fluid communication with the exit opening 192*a*'", 192*b*'" through the passage 190*a*'", 190*b*'", respectively.

The intermediate member 180*c*'" may be disposed within the housing 16". For example, the intermediate member 180*c*'" may be disposed within the passage 190*b*'" of the outer member 180*b*'" and extend from the proximal ends 182*a*'", 182*b*'" to the distal ends 184*a*'", 184*b*'" of the inner and outer members 180*a*'", 180*b*'". In particular, the intermediate member 180*c*'" may be disposed between the inner and outer members 180*a*'", 180*b*'", such that the intermediate member 180*c*'" engages the outer surface 188*a*'" of the inner member 180*a*'" and the inner surface 186*b*'" of the outer member 180*b*'".

Figure 13A:
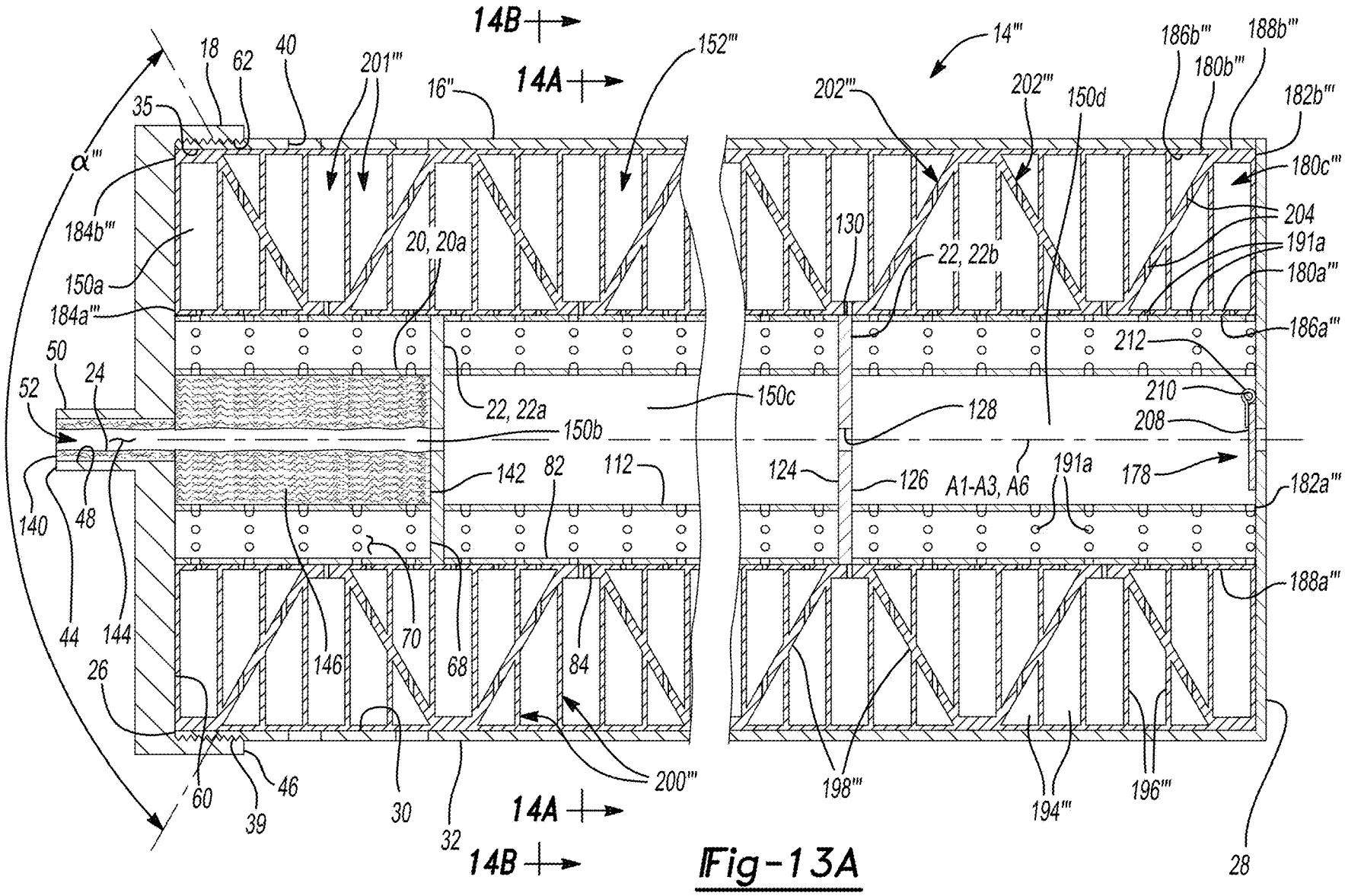
FIG. 13A is a cross-sectional view of the sound suppressor of FIG. 7 including the shell assembly of FIG. 12, and similar to the cross-sectional view of the sound suppressor of FIG. 7 illustrated in FIG. 9A, showing a door assembly in a closed position.

As illustrated in FIGS. 13A-14B, the intermediate member 180*c* may include a plurality of first fins 194'", a plurality of second fins 196", and a plurality of third fins 198". As illustrated in FIG. 13A, the fins 194" may each extend in a direction substantially (+/−5 degrees) parallel to the longitudinal axis A6 from the proximal end 26 of the housing 16" to the distal end 28 of the housing 16". As illustrated in FIGS. 14A and 14B, the fins 194 may be equally-spaced about the axis A6 and extend radially in a direction substantially (+/−5 degrees) perpendicular to the inner and outer members 180*a*'", 180*b*'". In particular, the fins 194 may abut, and extend perpendicularly from, the outer surface 188*a*'" of the inner member 180*a*'" and the inner surface 186*b*'" of the outer member 180*b*'". While the intermediate member 180*c*'" is generally shown and described herein as including twelve fins 194'", the intermediate member 180*c*'" may include more or less than twelve fins within the scope of the present disclosure.

Figure 13B:
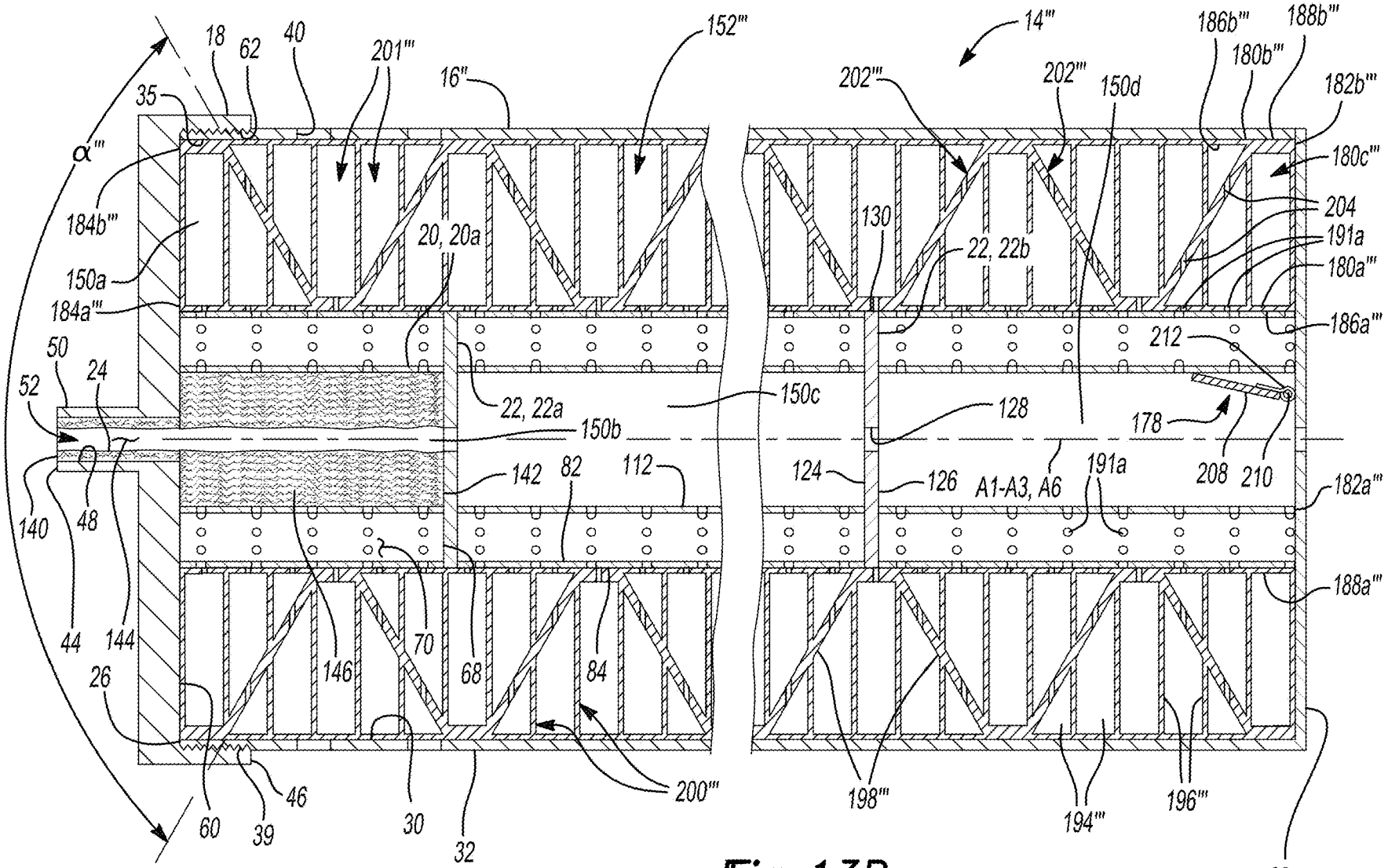
FIG. 13B is a cross-sectional view of the sound suppressor of FIG. 7 including the shell assembly of FIG. 12, and similar to the cross-sectional view of the sound suppressor of FIG. 7 illustrated in FIG. 9A, showing the door assembly in an open position.

The fins 196'" may extend in a direction substantially (+/−5 degrees) perpendicular to the longitudinal axis A6 and substantially (+/−5 degrees) perpendicular to the fins 194'". In particular, each fin 196'" may extend from and between adjacent ones of the fins 194'", such that a plurality of fins 196'" surround the longitudinal axis A6. In this regard, as illustrated in FIGS. 14A and 14B, the fins 196'" may form a plurality of rectangular-shaped patterns 200'" surrounding the axis A6. As illustrated in FIGS. 13A and 13B, the rectangular-shaped patterns 200'" may be equally-spaced along the axis A6. As further illustrated in FIGS. 13A and 13B, the fins 196'" may further extend in a direction substantially (+/−5 degrees) perpendicular to the inner and outer members 180*a*'", 180*b*'". In particular, the fins 196'" may abut, and extend perpendicularly from, (i) the outer surface 188*a*'" of the inner member 180*a*'" and the inner surface 186*b*'" of the outer member 180*b*'", and (ii) adjacent fins 194'". Accordingly, the fins 194'", 196'" may define a plurality of chambers 201'" between the inner and outer members 180*a*'", 180*b*'".

With reference to FIGS. 13A and 13B, the fins 198'" may extend between adjacent pairs of the fins 194'", between adjacent pairs of the fins 196'", or between the inner and outer members 180*a*'", 180*b*'". In particular, each fin 198'" may extend from a first of the fins 194'" to a second of the fins 194'" and from a first of the fins 196'" to a second of the fins 196'", such that a plurality of fins 198'" surround the longitudinal axis A6 and extend through one or more of the chambers 201'". In this regard, as illustrated in FIGS. 14A and 14B, the fins 198'" may form a plurality of frustopyramidally-shaped constructs 202'" surrounding the axis A6. In this regard, each frustopyramidally-shaped construct 202'" may define a square shape in a cross-section taken perpendicular to the axis A6, as illustrated in FIGS. 14B. In some implementations, each fin 198'" extends between the inner and outer members 180*a*'", 180*b*'" such that the frustopyramidally-shaped constructs 202'" define an apex angle α'". The apex angle α'" may be between five degrees and one hundred seventy degrees. In some implementations, the apex angle α'" may be substantially equal to one hundred fifteen degrees. The frustopyramidally-shaped constructs 202" may be equally-spaced along the axis A6 to define a corrugated construct disposed between the inner and outer members 180*a*", 180*b*'". In particular, the apex angles α'" of the frustopyramidally-shaped constructs 202 may alternate such that the apex angles α'" of consecutive frustopyramidally-shaped constructs 202'" face in opposite directions. For example, the apex angle α'" of a first of the frustopyramidally-shaped constructs 202'" may face the proximal end 182*a*'" of the inner member 180*a*'", while the apex angle α'" of a second of the frustopyramidally-shaped constructs 202'", adjacent the first of the frustopyramidally-shaped constructs 202'", faces the distal end 182*b*'" of the inner member 180*a*'". In some implementations, the apex (e.g., the smallest cross-sectional area) of a first of the frustopyramidally-shaped constructs 202'" is adjacent the apex (e.g., the smallest cross-sectional area) of a second of the frustopyramidally-shaped constructs 202'", while the base (e.g., the largest cross-sectional area) of the first of the frustopyramidally-shaped constructs 202'" is adjacent the base (e.g., the largest cross-sectional area) of the second of the frustopyramidally-shaped constructs 202'".

Each fin 198'" may include one or more of the perforations or apertures 204 extending therethrough. As previously described, the fins 194'", 196'", or 198'" may define, or otherwise be formed at least in part from, a material or construct configured to control, direct, and manipulate sound waves. For example, the fins 194'", 196'", or 198'" may be formed from, or otherwise define, an acoustic metamaterial configured to deviate the soundwaves transmitted through the intermediate member 180*c*'" and reduce the volume of sound produced by such soundwaves.

In an assembled configuration, the inner sleeves 20, 20*a*, the baffles 22, the insulator 24, and the intermediate shell assembly 152", 152'" may be removably disposed within the housing 16, 16', 16". In this regard, a method of assembling the sound suppressor 14, 14', 14", 14'" may include placing the inner sleeves 20, 20*a*, the baffles 22, the insulator 24, and the intermediate shell assembly 152", 152'" within the housing 16, 16', 16". In some implementations, the inner sleeves 20, 20*a*, the baffles 22 and the insulator 24 may be disposed within the intermediate shell assembly 152", 152'" prior to placing the intermediate shell assembly 152", 152'" within the housing 16, 16', 16". Accordingly, placing the inner sleeves 20, 20*a*, the baffles 22, the insulator 24, and the intermediate shell assembly 152", 152'" within the housing 16, 16', 16" may include translating the intermediate shell assembly 152", 152'", including the inner sleeves 20, 20*a*, the baffles 22, the and insulator 24 disposed therein, through the entrance opening 35 and the passage 34 along the axis A1 until the proximal end 182*a*, 182*a*'" of the inner member 180*a*, 180*a*'" and the proximal end 182*b*, 182*b*'" of the outer member 180*b*, 180*b*'" abut the distal end 28 of the housing 16, 16', 16". The method of assembling the sound suppressor 14, 14', 14", 14'" may also include coupling the endcap 18, including a portion of the insulator 24 disposed therein, to the housing 16, 16', 16". For example, the method may include coupling the threaded portion 62 of the endcap 18 to the threaded portion 39 of the housing 16, 16', 16" until the shoulder 60 of the endcap 18 abuts the distal end 184*a*, 184*a*'" of the inner member 180*a*, 180*a*'" and the distal end 184*b*, 184*b*'" of the outer member 180*b*, 180*b*'" to secure the intermediate shell assembly 152", 152'", including the inner sleeves 20, 20*a*, the baffles 22, the and insulator 24 disposed therein, within the housing 16, 16', 16", and prevent movement (e.g., translation, rotation, etc.) of the intermediate shell assembly 152", 152'", including the inner sleeves 20, 20*a*, the baffles 22, the and insulator 24 disposed therein, relative to the axis A1 of the housing 16, 16', 16".

Figure 15:
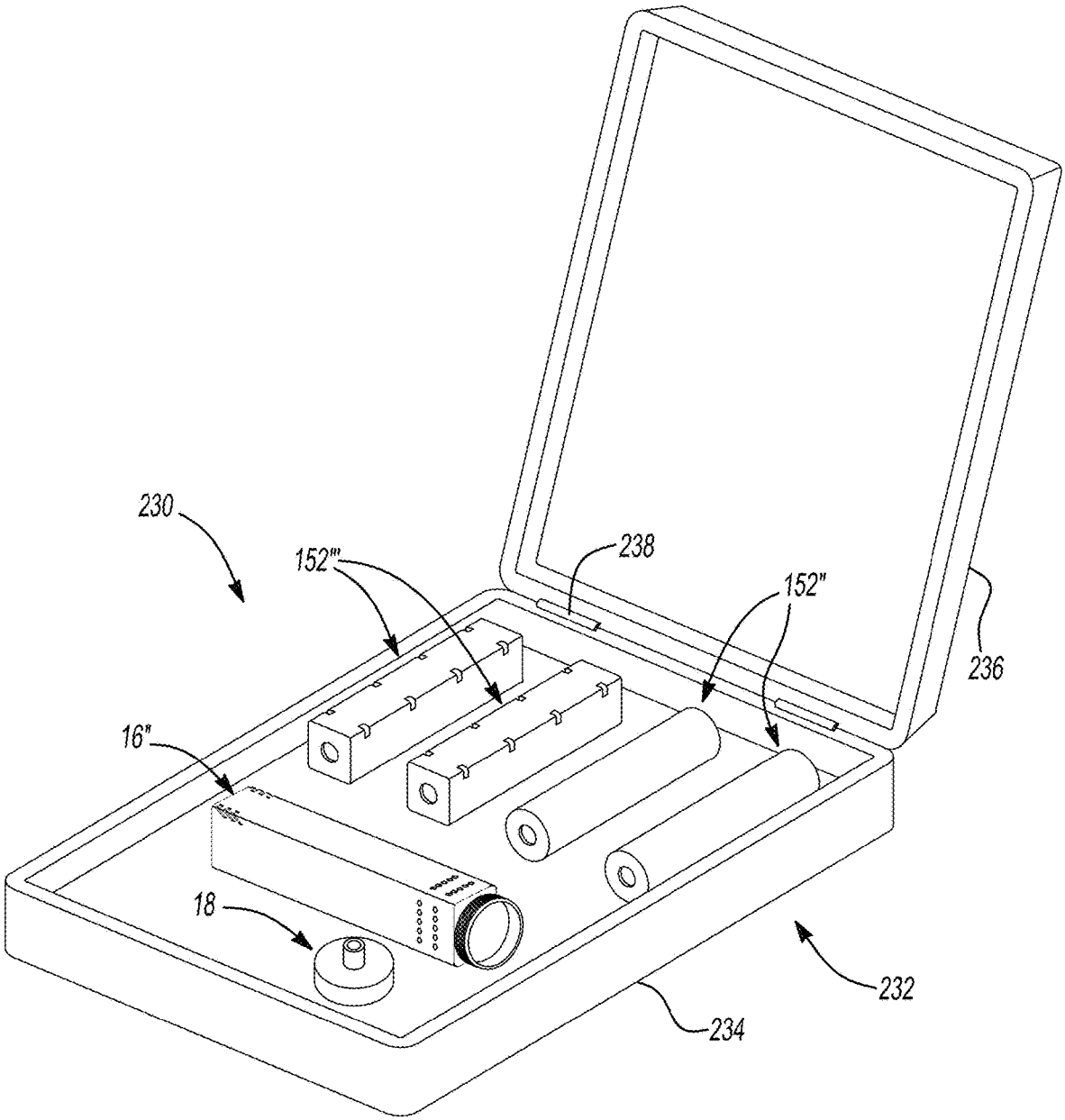
FIG. 15 is a perspective view of a kit for use with a sound suppressor in accordance with the principles of the present disclosure.

With reference to FIG. 15, a sound suppressor kit 230 is illustrated. The kit 230 may include a case or container 232, a housing 16, 16', 16", an endcap 18, and a plurality of intermediate shell assemblies 152", 152'", including the inner sleeves 20, 20*a*, the baffles 22, the and insulator 24 disposed therein. The container 232 may include a base 234 and a cover 236. In some implementations, the cover 236 may be coupled to the base 234 by one or more hinges 238, such that the cover 236 can be moved relative to the base 234 between an open position and a closed position.

The plurality of intermediate shell assemblies 152", 152'" may include one or more of the shell assemblies 152" and one more of the shell assemblies 152'''. While the kit 230 is generally shown as including zero shells 152, two shell assemblies 152'' and two shell assemblies 152''', it will be appreciated that the kit 230 may include more or less than zero shells 152, more or less than two shell assemblies 152'' and more or less than two shell assemblies 152''' within the scope of the present disclosure. In this regard, each shell assembly 152'', 152''' may define different sound-reducing characteristics relative to the others of the other shell assemblies 152'', 152'''. In particular, the construct, including the size, location, quantity or orientation of the inner sleeves 20, 20*a*, the apertures 90, the peaks 84, the troughs 86, the fins 194, 196, 198, 194''', 196''', 198''', the apertures 191*a*, 191*b*, the apertures 204, the angle a, the thicknesses T5*a*, T5*b*, or the vents 214 of a first shell assembly 152'', 152''' may be different than the size, location, quantity or orientation of the inner sleeves 20, 20*a*, the apertures 90, the peaks 84, the troughs 86, the fins 194, 196, 198, 194''', 196''', 198''', the apertures 191*a*, 191*b*, the apertures 204, the angle a, the thicknesses T5*a*, T5*b*, or the vents 214 of a second shell assembly 152'', 152''' of the plurality of intermediate shell assemblies 152'', 152'''. Accordingly, the profile or characteristics (e.g., frequency, amplitude, period, etc. of sound waves) of a sound suppressed by the first of the plurality of intermediate shell assemblies 152'', 152''' may be different (e.g., greater than or less than) than the profile or characteristics of a sound suppressed by the second of the plurality of intermediate shell assemblies 152'', 152'''. Thus, a user may use a first shell assembly 152'', 152''' in the housing 16, 16', 16'' during use of the suppressor 14, 14', 14'', 14''' with a first firearm 12 producing a first set of sound characteristics (e.g., frequency, amplitude, period, etc. of sound waves), and a second shell assembly 152'', 152''' in the housing 16, 16', 16'' during use of the suppressor 14, 14', 14'', 14''' with a second firearm 12 that is different than the first firearm and produces a second set of sound characteristics that are different than the first set of sound characteristics. In this regard, the user may remove the first shell assembly 152'', 152''' from the housing 16, 16', 16'' after use of the suppressor 14, 14', 14'', 14''' with the first firearm 12, and insert the second shell assembly 152'', 152''' in the housing 16, 16', 16'' during use of the suppressor 14, 14', 14'', 14''' with the second firearm 12.

In use, a bullet or other projectile may be discharged from the firearm 12, producing high pressure gas and generating a sound. High pressure gas may exit the barrel of the firearm 12 and pass through the sound suppressor 14, 14', 14'', 14'''. As the high pressure gas passes through the sound suppressor 14, 14', 14'', 14''' the configuration and arrangement (e.g., relative size, shape, location, quantity, orientation, material, etc.), as described herein, of the housing 16'', the sleeves 20*a*, 20*b*, the expansion device 23, the shell assembly 152'', 152''' and/or the door assembly 178 can help to reduce the volume of sound generated by the firearm 12. For example, high pressure gas passing through the sound suppressor 14, 14', 14'', 14''' and the passage 34, and out of the opening 38, may apply a force on the door 208 and produce a torque about the axis A7. The force produced by the high pressure gas may rotate the door 208 about the axis A7 from the open position (FIG. 9B, 13B) to the closed position (FIG. 9A. 13A), thereby trapping the high pressure gas within the suppressor 14, 14', 14'', 14''' for dissipation of the volume of sound by the sleeves 20*a*, 20*b*, the expansion device 23, and/or the shell assembly 152'', 152''' as described herein. In particular, rotation of the door 208 from the open position (FIG. 9A) to the closed position (FIG. 9B) can force the high pressure gas, sound waves, and pressure, through the apertures 90, 120, 191*a*, 191*b*, 204 and the vents 214 in order to reduce the volume of the sound produced by the firearm 12.

The configuration and arrangement of the apertures 90, 120, 191*a*, 204 can help to resist the flow of gas therethrough, thereby absorbing the energy of the expanding gas and reducing the volume of the sound generated by the gas. In particular, the size, shape, and arrangement of the apertures 90, 120, 191*a*, 204 restricts or impedes the flow of gas therethrough, thereby generating friction between the gas and the sleeves 20*a*, 20*b*, the inner member 180*a*, 180*a'''*, the outer member 180*b*, 180*b'''*, and the intermediate member 180*c*, 180*c'''* at the apertures 90, 120, 191*a*, 204 respectively.

The friction generated between the gas and the sleeves 20*a*, 20*b*, the inner member 180*a*, 180*a'''*, the outer member 180*b*, 180*b'''*, or the intermediate member 180*c*, 180*c'''* converts the kinetic energy of the gas flowing through the suppressor 14, 14', 14'', 14''' into heat energy. Similarly, the configuration and arrangement of the inner member 180*a*, 180*a'''*, the outer member 180*b*, 180*b'''*, or the intermediate member 180*c*, 180*c'''* can help to capture and dissipate the kinetic energy of the gas flowing through the suppressor 14, 14', 14''. For example, the acoustic metamaterial of the inner member 180*a*, 180*a'''*, the outer member 180*b*, 180*b'''*, or the intermediate member 180*c*, 180*c'''* can absorb various wavelengths of soundwaves passing through the suppressor 14, 14', 14'', 14''', thereby reducing the volume of the sound generated by the firearm 12. The configuration and arrangement of the housing 16', housing 16'' (e.g., the square or rectangular prism cross-sectional shape) can help to prevent the formation of a helical vortex of gas flowing through the suppressor 14, 14', 14'', 14''', thereby reducing the amount of energy in, and the volume of sound generated by, the gas.

The heat energy generated by the friction of the gas flowing through the suppressor 14, 14', 14'', 14''' is absorbed by the sleeves 20*a*, 20*b*, thereby reducing the temperature and the pressure of the gas flowing through the suppressor 14, 14', 14'', 14'''. As the pressure of the gas flowing through the suppressor 14, 14', 14'', 14''' is reduced, the volume of the sound generated by the gas flowing through the exit opening 38 of the housing 16, 16', 16'' may be reduced. For example, the configuration of the suppressor 14, 14', 14'', 14''' described herein may reduce the volume of the sound generated by the gas flowing through the exit opening 38 of the housing 16, 16', 16'', upon the firing or discharging of the firearm 12, by more than 30 decibels. In some implementations, the configuration of the suppressor 14, 14', 14'', 14''' described herein may reduce the volume of the sound generated by the gas flowing through the exit opening 38 of the housing 16, 16', 16'', upon the firing or discharging of the firearm 12, by more than 40 decibels.

After the suppressor 14, 14', 14'', 14''' has reduced the pressure of the gas therein to a predetermined level, the force of the biasing member 212 on the door 208 will overcome the opposing force of the gas on the door 208, thereby causing the door 208 to rotate about the axis A7 from the closed position (FIG. 9A, 13A) to the open position (FIG. 9B, 13B), and allowing the user to utilize the firearm 12 to discharge another bullet or projectile.

The following Clauses provide an exemplary configuration for a sound suppressor for a firearm, as described above.

Clause 1: A sound suppressor for a firearm, the sound suppressor comprising, a housing extending along, and disposed about, a central axis, and a first sleeve concentrically disposed within the housing and defining a plurality of first undulations disposed about the central axis, each first undulation defining a plurality of first apertures.

Clause 2: The sound suppressor of Clause 1, wherein each of the first apertures defines a first maximum dimension extending across the first aperture, and wherein the first maximum dimension is less than one millimeter.

Clause 3: The sound suppressor of Clause 2, wherein the first maximum dimension is less than a half millimeter.

Clause 4: The sound suppressor of Clause 2, wherein each of the first apertures extends through a thickness of the first sleeve, and wherein the thickness is greater than two hundred percent of the first maximum dimension.

Clause 5: The sound suppressor of Clause 1, further comprising a second sleeve concentrically disposed within the first sleeve and defining a plurality of second undulations disposed about the central axis, each second undulation defining a plurality of second apertures.

Clause 6: The sound suppressor of Clause 5, wherein each of the second apertures defines a second maximum dimension extending across the second aperture, and wherein the second maximum dimension is less than one millimeter.

Clause 7: The sound suppressor of Clause 5, wherein at least one of the first sleeve or the second sleeve is formed from one of aluminum or an aluminum alloy.

Clause 8: The sound suppressor of Clause 1, wherein each of the plurality of first undulations defines a U-shape or a V-shape.

Clause 9: A sound suppressor for a firearm, the sound suppressor comprising, a housing defining a first central passage, and a first sleeve disposed within the first central passage and including a plurality of first undulations defining a second central passage, each first undulation defining a plurality of first apertures in fluid communication with the first central passage and the second central passage.

Clause 10: The sound suppressor of Clause 9, wherein each of the first apertures defines a first maximum dimension extending across the first aperture, and wherein the first maximum dimension is less than one millimeter.

Clause 11: The sound suppressor of Clause 10, wherein the first maximum dimension is less than a half millimeter.

Clause 12: The sound suppressor of Clause 10, wherein each of the first apertures extends through a thickness of the first sleeve, and wherein the thickness is greater than two hundred percent of the first maximum dimension.

Clause 13: The sound suppressor of Clause 9, further comprising a second sleeve disposed within the second central passage and including a plurality of second undulations defining a third central passage, each second undulation defining a plurality of second apertures in fluid communication with the second central passage and the third central passage.

Clause 14: The sound suppressor of Clause 13, wherein each of the second apertures defines a second maximum dimension extending across the second aperture, and wherein the second maximum dimension is less than one millimeter.

Clause 15: The sound suppressor of Clause 13, wherein at least one of the first sleeve or the second sleeve is formed from one of aluminum or an aluminum alloy.

Clause 16: The sound suppressor of Clause 9, wherein each of the plurality of first undulations defines a U-shape or a V-shape.

Clause 17: A sound suppressor for a firearm, the sound suppressor comprising, a housing, and a first sleeve disposed within the housing and having a first inner surface and a first outer surface, at least one of the first inner surface or the first outer surface defining a plurality of first undulations, each first undulation defining a plurality of first apertures extending through the first inner surface and the first outer surface.

Clause 18: The sound suppressor of Clause 17, wherein each of the first apertures defines a first maximum dimension extending across the first aperture, and wherein the first maximum dimension is less than one millimeter.

Clause 19: The sound suppressor of Clause 18, wherein the first maximum dimension is less than a half millimeter.

Clause 20: The sound suppressor of Clause 18, wherein each of the first apertures extends through a thickness of the first sleeve, and wherein the thickness is greater than two hundred percent of the first maximum dimension.

Clause 21: The sound suppressor of Clause 17, further comprising a second sleeve disposed within the first sleeve and having a second inner surface and a second outer surface, at least one of the second inner surface or the second outer surface defining a plurality of second undulations, each second undulation defining a plurality of second apertures extending through the second inner surface and the second outer surface.

Clause 22: The sound suppressor of Clause 21, wherein at least one of the first sleeve or the second sleeve is formed from one of aluminum or an aluminum alloy.

Clause 23: The sound suppressor of Clause 17, wherein each of the plurality of first undulations defines a U-shape or a V-shape.

Clause 24: A sound suppressor for a firearm, the sound suppressor comprising, a housing extending along, and disposed about, a central axis, an outer shell concentrically disposed within the housing, an inner shell concentrically disposed within the outer shell and defining a plurality of first apertures, and an intermediate member disposed between the inner shell and the outer shell and formed at least in part from an acoustic metamaterial.

Clause 25: The sound suppressor of Clause 24, wherein each of the first apertures defines a maximum dimension extending across the first aperture, and wherein the maximum dimension is less than one millimeter.

Clause 26: The sound suppressor of Clause 25, wherein the maximum dimension is less than a half millimeter.

Clause 27: The sound suppressor of Clause 25, wherein each of the first apertures extends through a thickness of the inner shell, and wherein the thickness is greater than two hundred percent of the maximum dimension.

Clause 28: The sound suppressor of Clause 24, wherein at least one of the inner shell or the outer shell is formed from one of aluminum or an aluminum alloy.

Clause 29: The sound suppressor of Clause 24, further comprising a sleeve disposed within the inner shell and including a plurality of undulations defining a plurality of second apertures.

Clause 30: The sound suppressor of Clause 29, wherein the sleeve defines a central passage in fluid communication with the plurality of first apertures and the plurality of second apertures.

Clause 31: The sound suppressor of Clause 29, wherein each of the second apertures defines a second maximum dimension extending across the second aperture, and wherein the second maximum dimension is less than one millimeter.

Clause 32: The sound suppressor of Clause 31, wherein the second maximum dimension is less than a half millimeter.

Clause 33: The sound suppressor of Clause 31, wherein each of the second apertures extends through a thickness of the sleeve, and wherein the thickness is greater than two hundred percent of the second maximum dimension.

Clause 34: The sound suppressor of Clause 29, wherein the sleeve is formed from one of aluminum or an aluminum alloy.

Clause 34: The sound suppressor of Clause 29, wherein each of the plurality of undulations defines a U-shape or a V-shape.

Clause 35: A sound suppressor for a firearm, the sound suppressor comprising, a housing extending from a proximal end to a distal end along a central passage, the proximal end configured to receive the firearm, the distal end defining an exit opening, and a door pivotally supported by the housing for rotation between an open position and a closed position, the door at least partially blocking the exit opening in the closed position, wherein the door is configured to rotate from the open position to the closed position upon passage of a projectile through the exit opening.

Clause 36: The sound suppressor of Clause 35, further comprising a biasing member operable to rotate the door from the closed position to the open position after passage of the projectile through the exit opening.

Clause 37: The sound suppressor of Clause 35, further comprising, an outer shell concentrically disposed within the housing, an inner shell concentrically disposed within the outer shell and defining a plurality of apertures, and an intermediate member disposed between the inner shell and the outer shell and formed at least in part from an acoustic metamaterial.

Clause 38: The sound suppressor of Clause 37, wherein each of the apertures defines a maximum dimension extending across the aperture, and wherein the maximum dimension is less than one millimeter.

Clause 39: The sound suppressor of Clause 35, further comprising a sleeve disposed within the housing and including a plurality of undulations defining a plurality of apertures in fluid communication with the central passage.

Clause 40: The sound suppressor of Clause 39, wherein each of the plurality of undulations defines a U-shape or a V-shape.

Clause 41: The sound suppressor of Clause 39, wherein each of the apertures defines a maximum dimension extending across the aperture, and wherein the maximum dimension is less than one millimeter.

Clause 42: The sound suppressor of Clause 41, wherein each of the apertures extends through a thickness of the sleeve, and wherein the thickness is greater than two hundred percent of the maximum dimension.

Clause 43: A sound suppressor kit for a firearm, the sound suppressor kit comprising, a housing, a first shell assembly configured to be removably coupled to the housing and configured to reduce a volume of a first sound having a first frequency, and a second shell assembly configured to be removably coupled to the housing and configured to reduce a volume of a second sound having a second frequency that is different than the first frequency.

Clause 44: The sound suppressor kit of Clause 44, wherein the housing defines an opening and a passage in fluid communication with the opening, and wherein the first shell assembly and the second shell assembly are each configured to be removably inserted through the opening and into the passage.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A suppressor for a firearm, the suppressor comprising:

a housing defining a first central passage; and a shell assembly concentrically disposed within the first central passage and defining a second central passage, the shell assembly including an inner member and a plurality of fins extending from the inner member, wherein:

the inner member defines one or more apertures, the plurality of fins define one or more chambers and one or more other apertures in fluid communication with the one or more apertures and the second central passage, the plurality of fins include a first fin, a second fin, and a third fin, the first and second fins extend from the inner member in a first direction, and the third fin extends from the inner member in a second direction that intersects the first direction.

2. The suppressor of claim 1, wherein the plurality of fins extend radially and axially within the first central passage.

3. The suppressor of claim 1, wherein the first fin of the plurality of fins defines an angle greater than zero degrees and less than ninety degrees relative to a central axis of the second central passage.

4. The suppressor of claim 3, wherein the second fin of the plurality of fins defines an angle greater than zero degrees and less than ninety degrees relative to the central axis.

5. The suppressor of claim 1, wherein the shell assembly is formed at least in part from a metal material.

6. The suppressor of claim 1, wherein the shell assembly is concentrically disposed within the housing.

7. The suppressor of claim 1, wherein the inner member defines a cylindrical construct.

8. The suppressor of claim 1, wherein the plurality of fins define a first fluid passage and a second fluid passage in fluid communication with the first fluid passage.

9. The suppressor of claim 8, wherein:

the inner member defines a plurality of apertures, and at least one aperture of the plurality of apertures is in fluid communication with the second central passage, the first fluid passage, and the second fluid passage.

10. The suppressor of claim 1, wherein the shell assembly forms a metamaterial.

11. The suppressor of claim 1, wherein:

the first fin defines a first plane, and the second fin defines a second plane orthogonal to the first plane.

* * * * *